US005541473A

United States Patent [19]

Duboc, Jr. et al.

[11] Patent Number: 5,541,473

[45] Date of Patent: Jul. 30, 1996

[54] GRID ADDRESSED FIELD EMISSION CATHODE

[75] Inventors: Robert M. Duboc, Jr., Menlo Park; Paul A. Lovoi, Saratoga, both of Calif.

[73] Assignee: Silicon Video Corporation, San Jose, Calif.

[21] Appl. No.: 12,297

[22] Filed: Feb. 1, 1993

Related U.S. Application Data

[63] Continuation-in-part of Ser. No. 867,044, Apr. 10, 1992, Pat. No. 5,424,605.

[51] Int. Cl.[6] ..... H01J 29/70

[52] U.S. Cl. ..... 313/422; 313/495; 313/496; 313/497; 313/309; 313/336

[58] Field of Search ..... 313/309, 336, 313/351, 310, 422, 495, 496, 497; 315/169.1, 71, 349

[56] References Cited

U.S. PATENT DOCUMENTS

| | | | |
|---|---|---|---|
| 3,330,707 | 7/1967 | Reed | 156/3 |
| 3,566,187 | 2/1971 | DuBois | 315/169 |
| 3,612,944 | 10/1971 | Requa et al. | 315/12 |
| 3,622,828 | 11/1971 | Zinn | 313/103 |
| 3,753,022 | 8/1973 | Fraser, Jr. | 313/78 |
| 3,755,704 | 8/1973 | Spindt et al. | 313/309 |
| 3,789,471 | 2/1974 | Spindt et al. | 29/25.17 |
| 3,855,499 | 12/1974 | Yamada et al. | 315/169 |
| 3,935,499 | 1/1976 | Oess | 313/413 |
| 3,936,697 | 2/1976 | Scott | 313/495 |
| 3,956,667 | 5/1976 | Veith | 315/169 |
| 4,020,381 | 4/1977 | Oess . | |
| 4,075,535 | 2/1978 | Genequand et al. . | |
| 4,088,920 | 5/1978 | Siekanowicz et al. | 313/422 |
| 4,227,117 | 10/1980 | Watanabe et al. | 315/13 R |
| 4,341,980 | 7/1982 | Noguchi et al. | 315/169.1 |
| 4,435,672 | 3/1984 | Heynisch | 315/366 |
| 4,451,759 | 5/1984 | Heynisch | 313/495 |
| 4,531,122 | 7/1985 | Redfield | 340/781 |
| 4,564,790 | 1/1986 | Veith | 315/169.4 |
| 4,618,801 | 10/1986 | Kakino . | |
| 4,677,259 | 6/1987 | Abe | 178/18 |
| 4,719,388 | 1/1988 | Oess | 315/169.1 |
| 4,728,851 | 3/1988 | Lambe | 313/309 |
| 4,820,661 | 4/1989 | Nair | 501/79 |
| 4,857,799 | 8/1989 | Spindt et al. | 313/495 |
| 4,867,935 | 9/1989 | Morrison, Jr. | 264/61 |
| 4,874,981 | 10/1989 | Spindt | 313/309 |

(List continued on next page.)

FOREIGN PATENT DOCUMENTS

| | | |
|---|---|---|
| 0436997A1 | 7/1991 | European Pat. Off. . |
| 0464938A1 | 1/1992 | European Pat. Off. . |
| 0580244A1 | 1/1994 | European Pat. Off. . |

OTHER PUBLICATIONS

C. A. Spindt et al., "Physical Properties of Thin–Film Field Emission Cathodes With Molybdenum Cones," Journal of Applied Physics, vol. 47, No. 12, Dec. 1976, pp. 5248–5263.

(List continued on next page.)

*Primary Examiner*—Donald J. Yusko
*Assistant Examiner*—Nimesh Patel
*Attorney, Agent, or Firm*—Skjerven, Morrill, MacPherson, Franklin & Friel; Alan H. MacPherson; Ronald J. Meetin

[57] ABSTRACT

A grid which controls electron flow, placed between a field emitter cathode and fluorescent anode in a flat cathode ray tube improves focusing, and reduces the switching voltage necessary to stop electron flow. The focusing capabilities of the grid enable increased distance between the cathode and anode, permitting higher anode voltage and use of more efficient phosphors. With the grid, electron flow on/off addressing can be done with drivers operating at less than 30 V, thereby reducing capacitive power loss over prior art addressable arrays and permitting use of inexpensive CMOS control circuitry. The grid's switching capabilities enable the use of a simplified field emitter cathode structure with resistive gate films which increase emitter reliability, emitter life, and, for cathode ray tube displays, the uniformity of the display.

15 Claims, 21 Drawing Sheets

U.S. PATENT DOCUMENTS

| | | | |
|---|---|---|---|
| 4,884,010 | 11/1989 | Biberian | 315/366 |
| 4,900,981 | 2/1990 | Yamazaki et al. | 313/422 |
| 4,904,895 | 2/1990 | Tsukamoto et al. | 313/336 |
| 4,908,539 | 3/1990 | Meyer | 315/169.3 |
| 4,923,421 | 5/1990 | Brodie et al. . | |
| 4,940,916 | 7/1990 | Borel et al. | 313/306 |
| 4,948,759 | 8/1990 | Nair | 501/17 |
| 4,954,744 | 9/1990 | Suzuki et al. | 313/336 |
| 4,956,574 | 9/1990 | Kane | 313/306 |
| 4,964,946 | 10/1990 | Gray et al. | 156/643 |
| 4,994,708 | 2/1991 | Shimizu et al. | 313/306 |
| 5,003,219 | 3/1991 | Muragishi et al. . | |
| 5,015,912 | 5/1991 | Spindt et al. | 313/495 |
| 5,053,673 | 10/1991 | Tomii et al. | 313/308 |
| 5,057,047 | 10/1991 | Greene et al. | 445/24 |
| 5,063,327 | 11/1991 | Brodie et al. . | |
| 5,070,282 | 12/1991 | Epsztein | 315/383 |
| 5,130,614 | 7/1992 | Staelin | 315/366 |
| 5,155,410 | 10/1992 | Wakasano et al. . | |
| 5,194,780 | 3/1993 | Meyer | 313/309 |
| 5,227,691 | 7/1993 | Murai et al. . | |
| 5,229,691 | 7/1993 | Shichao et al. . | |
| 5,272,419 | 12/1993 | Park | 313/495 |

OTHER PUBLICATIONS

C. A. Spindt et al., "Field Emission Array Development," 33rd International Field Emission Symposium, Fritz–Haber Institut, Berlin, 1986.

Akira Kaneko et al., "Field Emitter Array With Lateral Wedges," Technical Digest of IVMC 91, Nagahama 1991, pp. 50–51.

F. Levy et al., "Phosphors For Full–Color Microtips Fluorescent Displays," International Display Research Conference, Oct. 15–17, 1991, San Diego, CA, pp. 20–23.

R. Meyer, "Recent Development On 'Microtips' Display at Leti," Technical Digest of IVMC 91, Nagahama 1991, pp. 6–9, 1991.

I. Brodie, "Advanced Technology: Flat Cold–Cathode CRTs," Information Display, vol. 5, No. 1, pp. 17–19 (Jan. 1989).

I. Brodie, et al. "Vacuum Microelectronics," Advances In Electronics And Electron Physics, vol. 83, pp. 1–106, 1992.

R. Peterson, "Low Voltage (~300 V) Cathodoluminescence of Common CRT Phosphors," ECS Meeting, Abstract No. 201, vol. 80–1, pp. 528–531, May 1980.

R. Meyer, "6" Diagonal Microtips Fluorescent Display For T.V. Appplications," Eurodisplay '90 Disgest, pp. 374–377, 1990.

A. Takahashi et al. "Back Modulation Type Flat CRT," Japanese Display '92, pp. 377–380, 1992.

Lawrence Tannas, Jr., "Flat–Panel Display and CRTs," pp. 218–219, 231–232, 360, 400, 403, 1985.

N. C. Jaitly et al., "In–situ Insulator Surface Charge Measurements in Dielectric Bridged Vacuum Gaps Using an Electrostatic Probe," IEEE Transactions on Electrical Insulation, vol. 23, No. 2, Apr. 1988, pp. 261–273.

K. B. Blodgett, "Surface Conductivity of Lead Silicate Glass after Hydrogen Treatment," Journal of Am. Cer. Soc., vol. 34, No. 1, 1951, pp. 14–27.

N. Nishimura et al., "Metal–Film–Edge Field Emitter Array With A Self–Aligned Gate," Technical Digest of IVMC 91, Nagahama 1991, pp. 46–47, 1991.

K. Betsui, "Fabrication And Characteristics of Si Field Emitter Arrays," Technical Digest of IVMC 91, Nagahama 1991, pp. 26–29, 1991.

L. Reed, "Heat Treatment Studies on High Alumina Ceramics," Reprint from Sixth National Conference on Electron Tube Techniques, Pergamon Press, New York, 1963, pp. 15–29.

"A Digitally Addressed Flat–Panel CRT," by W. F. Goede, *IEEE Transactions on Electron Devices,* vol. ED–20, No. 11, Nov. 1973, pp. 1052–1061.

"Digital Address Thin Display Tube," by Walter F. Goede, published by Northrop Corporation in 1974, distributed by National Technical Information Services (U.S. Department of Commerce), pp. 1–134.

Dupont Electronics Brochure, "Green Tape Materials For Ceramics Circuits," brochure including specifications, 1988, 1991.

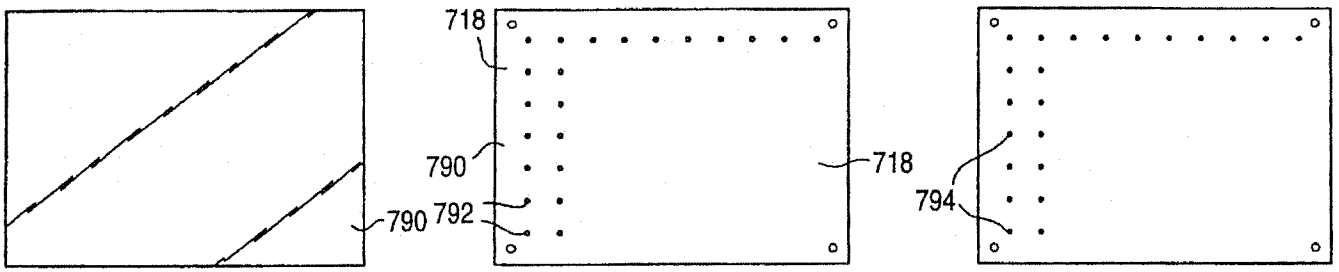
FIG. 7A
FIG. 7B
FIG. 7C
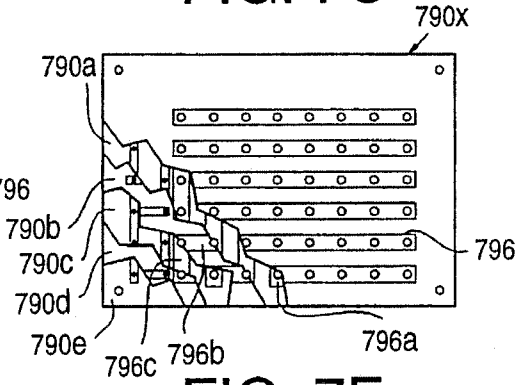
FIG. 7D
FIG. 7E
FIG. 7F
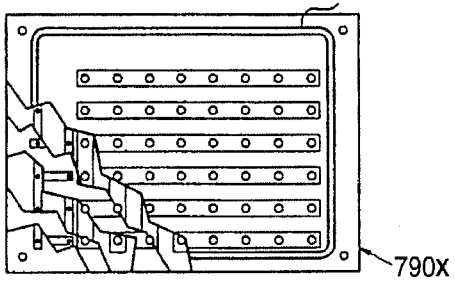
FIG. 7G
FIG. 7H
FIG. 7I

GRID ADDRESSED FIELD EMISSION CATHODE

CROSS-REFERENCE TO RELATED APPLICATION

This application is a continuation-in-part of U.S. patent application Ser. No. 07/867,044 filed Apr. 10, 1992, entitled "Self Supporting Flat Video Display", now U.S. Pat. No. 5,424,605.

This application is related to and incorporates by reference the U.S. patent application Ser. No. 08/012,542, now allowed, entitled "Internal Support Structure For Flat Panel Device" filed by Theodore S. Fahlen, Robert M. Duboc, Jr., and Paul A. Lovoi, filed on the same date as the present application.

BACKGROUND OF THE INVENTION

1. Field of the Invention

This invention relates to flat panel cathode ray tubes which utilize a field emitter cathode. In particular, the invention relates to the provision of a grid to control electron current between the field emitter cathode and phosphors on the anode in a flat cathode ray tube.

2. Description of Related Art

Numerous attempts have been made to construct a commercially practical flat panel cathode ray tube (CRT) (sometimes referred to as a "flat panel display"). None have been completely successful. One promising approach, known as a Field Emission Display (FED), utilizes a matrix of addressed cold cathode emitters.

FIG. 1 shows a view of a portion of a prior art flat CRT 150 including a field emission cathode 100. The field emission cathode 100 comprises a baseplate 101, emitters 104, row electrodes 102, column electrodes 103 and insulating layer 105. A faceplate 120, which is typically made of glass, is spaced apart less than 0.020" from the baseplate 101, and, though not shown by FIG. 1, forms a sealed enclosure with the baseplate 101. On the face plate 120 are an anode 121 and phosphor 122. The region between the faceplate 120 and baseplate 101 is held at a vacuum pressure of about $1\times10^{-7}$ torr. Spacers 110 help support the baseplate 101 and faceplate 120 against the force of atmospheric pressure from outside the CRT.

FIG. 1 exaggerates the size of emitters 104. The emitters 104 lie at the intersections of row electrodes 102 and column electrodes 103. The emitters 104 are formed on, and electrically connected to, row electrodes 102. The emitters 104 emit electrons toward phosphor 122 coated on faceplate 120. The phosphor 122 produces light when struck by electrons of the proper energy. An array of phosphors like phosphor 122 form pixels (the smallest individual picture element) on the display screen. In a black and white or gray-scale displays, there is typically one phosphor per pixel. In color displays, three or four phosphors form a single pixel.

A control circuit controls voltage levels of the row and column electrodes 102, 103 and establishes a bias voltage between the row electrodes 102 (and, thus, emitters 104) and the column electrodes 103. The voltage on the column electrodes 103 (gate voltage) causes an electric field which permits or prevents the emission of electrons from the emitters 104. For column electrode 103 having 1 to 1.5 micron emitter holes, a typical gate to emitter bias voltage which permits a sufficient flow of electrons from cold cathode emitters 104 is between 40 and 80 V.

Electrons emitted from the emitters 104 have an initial energy which depends on the gate to emitter bias voltage. Once liberated from the emitters 104, the electrons are accelerated by a positive voltage on anode 121. A typical anode voltage for a flat CRT with a field emitter cathode is 300 to 700 V. Voltages larger than 700 V tend to cause electrical breakdown in spacers 110 and consequent electrical shorting between the cathode and anode. Breakdown is caused by strong electric fields that result from the short distance between the cathode and anode, typically 0.020 inches (0.51 mm).

The cathode to anode distance cannot be increased because of focussing requirements. A typical flat CRT with field emitters uses proximity focusing, and the distance between cathode and anode must be approximately equal to the pixel pitch. (Pixel pitch is the distance between the centers of adjacent pixels.) If the distance is much greater, electrons from one set of emitters 104 strike more than one pixel and images formed on the CRT screen are blurred.

The accelerated electrons strike a phosphor 122 and cause an emission of light. The intensity of the light from each pixel depends on composition of the phosphor 122, the flux of electrons (number of electrons per area per second), and the energy of the electrons. The low anode voltage used in flat CRTs (300 to 700 V for flat CRTs as compared to 20 to 35 kV for conventional CRTs), is a problem with the prior art flat CRTs. The low voltage restricts the type and efficiency of the phosphors used. Higher anode voltages would permit the use of more efficient phosphors that require less power to produce a given amount of light.

Generally, formation of an image on the display screen requires turning on and off individual pixels. Video images on a matrix addressed flat CRT are usually formed a row at a time, starting with the top row. The intensity or color of pixels in the top row are set, then the intensity of the following row of pixels is set, then the next, continuing row by row until the last row is reached at which time the cycle is repeated. This requires charging and discharging of row electrodes 102 at first frequency, and charging and discharging of the column electrodes 103 at a second higher frequency. The power used during charging is $\frac{1}{2}CV^2$, where C is the capacitance and V is the bias voltage between the row and column electrodes. Since power use goes up as the square of the voltage, low bias voltages are desirable.

For gray-scale, or color images with more than 8 colors, the intensity of light from each pixel must be adjustable and controllable. Typically, the intensity is controlled by controlling the flux of electrons that strike a pixel. The flux of electrons is controlled by controlling the bias voltage between the column electrode 103 and the row electrode 102. Larger bias voltages cause more electrons to be emitted from the emitters 104. Accordingly, control circuitry must address individual sets of emitters 104 switch the electron flow on or off, and control the magnitude of the gate to emitter bias voltage. Further, typical gate to emitter bias voltages (40 to 80 V) prevent the use of inexpensive CMOS drivers as control circuits. Lower switching voltages and a way to avoid using variable voltage levels to control pixel intensity would make control circuitry less expensive.

Field emitter based flat CRTs have also been expensive to make because of the field emitter manufacturing cost. A dielectric layer 105 between the row electrodes 102 and column electrodes 103 is typically the same thickness as the diameter of the gate hole 106. This thickness of dielectric layer 105 is relatively thin so that dielectric layer 105 suffers from high electric field stress. For example, with a 1 to 1.5 micron diameter gate hole, and a gate-to-emitter bias voltage of 40 to 80 V, the electric field across the dielectric layer 105 is comparable to fields which cause electrical breakdown in the dielectric layer 105. Defects or impurities in the dielectric layer 105 or the emitter surface can lead to shorts between the row and column electrodes 102, 103, resulting in a defective display. Also, foreign particles or defective emitters can lead to shorts or arcs between the gate films and the emitters.

To prevent such shorts from ruining a display, field emitter developers have proposed placing resistors (in the form of patterned resistive films) between the base of the emitters and the row (or base) electrodes. These resistors add cost to the field emitter cathode because they add another patterned thin film layer, and because accurate registration must be maintained between the resistor pattern and other layers in the field emitter structure.

If the gate film could be made from resistive material, then the resistor between the emitter 104 and row electrode 102 could be eliminated, enabling the use of non-patterned resistive films. This, in turn, would reduce the fabrication cost of the field emitter structure. Such a resistive gate film is not possible in a conventional field emission structure because the gate addressing frequencies require that the film be relatively conductive to charge and discharge the capacitance. Gate resistance of 10 ohms/□ or less are typically required when row or column addressing is done using resistively patterned gate film electrodes. Substantially higher resistance is required to protect against shorting and arcing.

SUMMARY OF THE INVENTION

In accordance with the present invention a grid is placed between a field emitter cathode and phosphors on an anode. In some embodiments of the invention the grid is used to switch on and off electron flow between parts of the field emitter cathode and the anode. With a grid performing switching operations, the bias voltage between the emitter and the gate remain constant or are switched at the row frequency. In some embodiments grid voltages as low as S V are sufficient to stop electron flow to the anode. Capacitive power loss is decreased and inexpensive CMOS control circuitry can be used. High switching rates in a grid permit pulse width modulation to control electron flux to the phosphors and pixel intensity.

In some embodiments, a grid is used to focus electrons from the field emitter cathode. Focusing is accomplished using holes which absorb wide angle electrons that collide with the walls of the holes and provide electric fields to focus the remaining electrons beam. With a better focussed electron beam, the anode and the cathode can be placed further apart and the anode voltage can be increased without risk of electric breakdown and unwanted current flow over the surface of the insulating spacers. The higher anode voltages, 4 to 5 kV, permits the use of aluminized phosphors and both higher electron energies and reflective aluminization result in higher light production power efficiencies. For example, phosphors without aluminization operating with a 300–500 volt anode potential may achieve 3 lumens output per watt of electron energy input. Aluminized phosphor operating at 10 kV anode potential can be expected to achieve in excess of 20 lumens per watt.

In other embodiments, the bottom layer of a grid electrically connects to different points on the field emitter. In some cases, all or most of the contacts required by the control circuitry are placed on the grid, and the grid provides an efficient place for control circuitry to attach to the CRT. In other cases, the grid connects separate elements such as emitter plates together to form a single field emitter cathode. This tiling of separate cathode elements via grid interconnections may be critical in applications such a big screen television where fabrication of an integrated field emitter may be difficult.

In many embodiments construction of the grids uses ceramic material which can be easily formed into the large grids necessary for a flat CRT. The ceramic materials can be acurately punched mechanically or drilled with a laser, can be shaped into planar or curved forms, then can be fired in to a strong, rigid, and vacuum compatable grid. Forming the grids of ceramics also allows the thermal coefficient of expansion of the grid to be closely matched with glass and other materials in the CRT. This minimizes separation problems and thermal stresses during manufacture and use of the CRT.

BRIEF DESCRIPTION OF THE DRAWINGS

FIGS. 7A through 7I (sometimes together referred to as FIG. 7) collectively show steps in a sequence of formation of a grid.

DETAILED DESCRIPTION OF THE PREFERRED EMBODIMENTS

Figure 1:
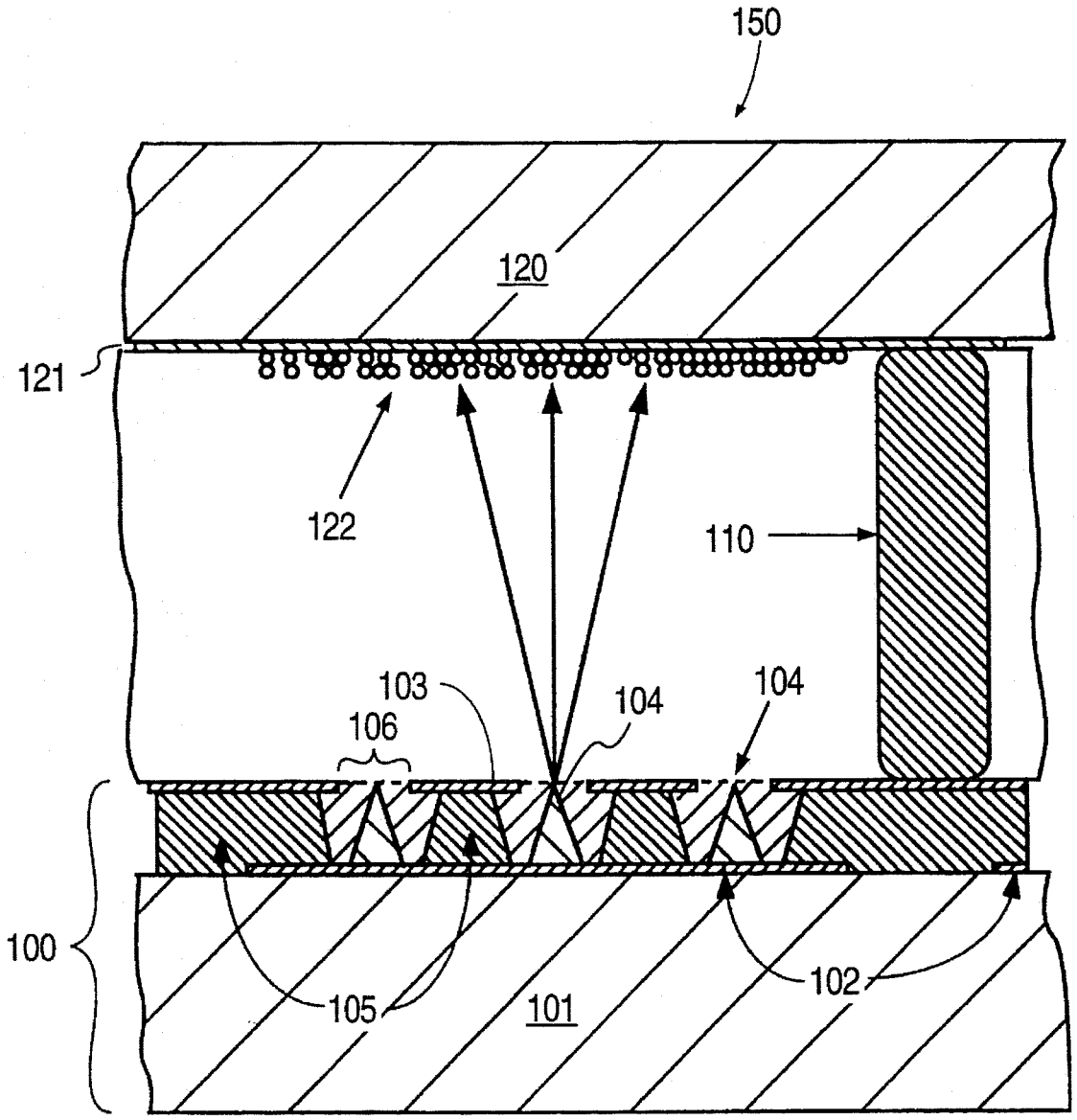
FIG. 1 (PRIOR ART)
FIG. 1 shows a cross-sectional view of a portion of a prior art flat CRT which uses a field emitter cathode.
Figure 2:
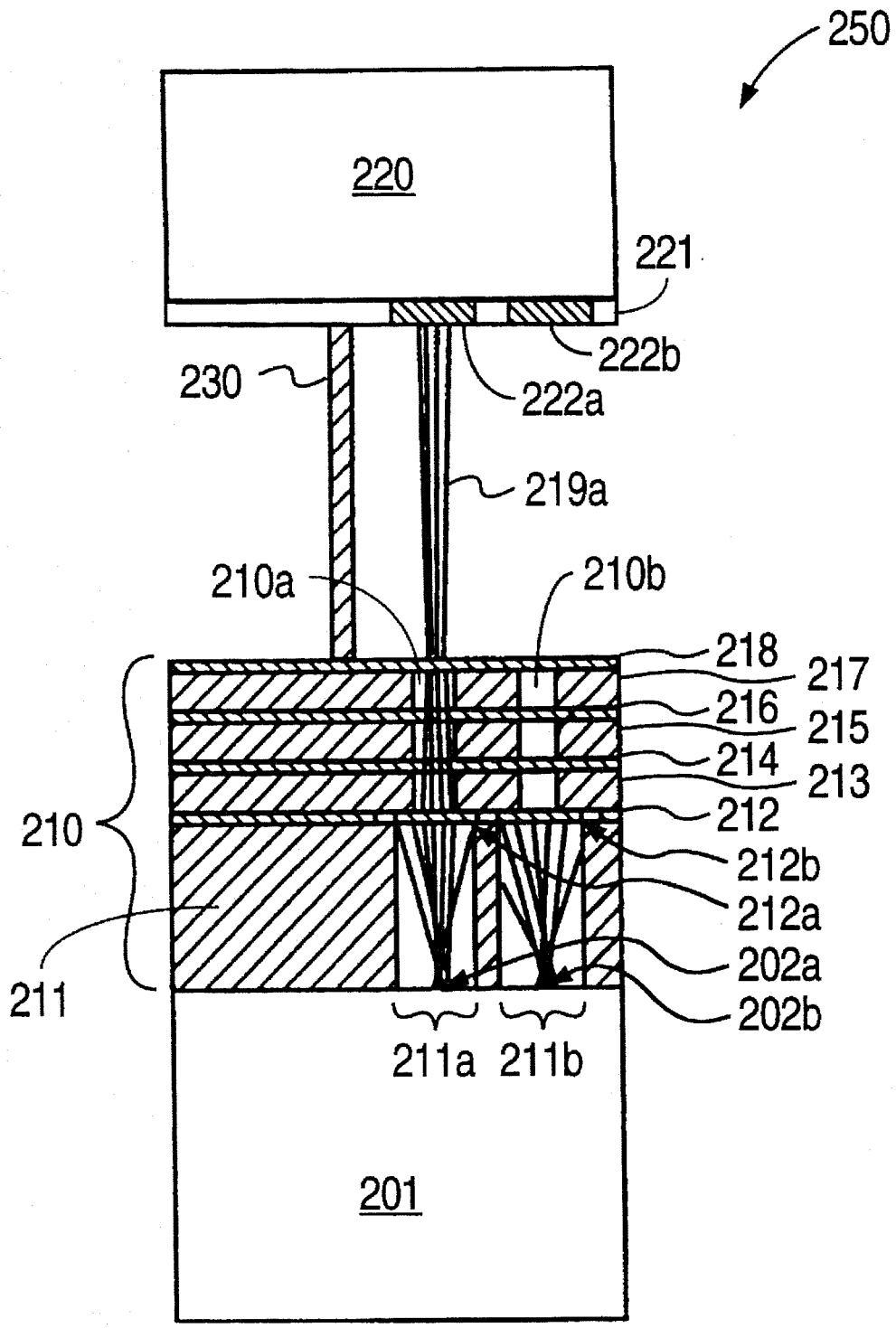
FIG. 2 shows a cross-sectional view of a portion of a flat CRT with a grid according to an embodiment of the invention.

FIG. 2 shows a cross-sectional view of a portion of a flat CRT 250 according to an embodiment of the invention, including a grid 210 and emitter sets 202*a*, 202*b*. For simplicity, only two emitter sets 202*a*, 202*b* are shown. Typically, in flat CRT 250 there are thousands of emitter sets, e.g., emitter sets 202*a*, 202*b*. Each emitter set 202*a*, 202*b* in FIG. 2 is a 0.001" square portion of the field emitter cathode. The emitter sets 202*a*, 202*b* include a 6 by 6 emitter array of cone-type emitters with a 0.0002" on center spacing.

Figure 3:
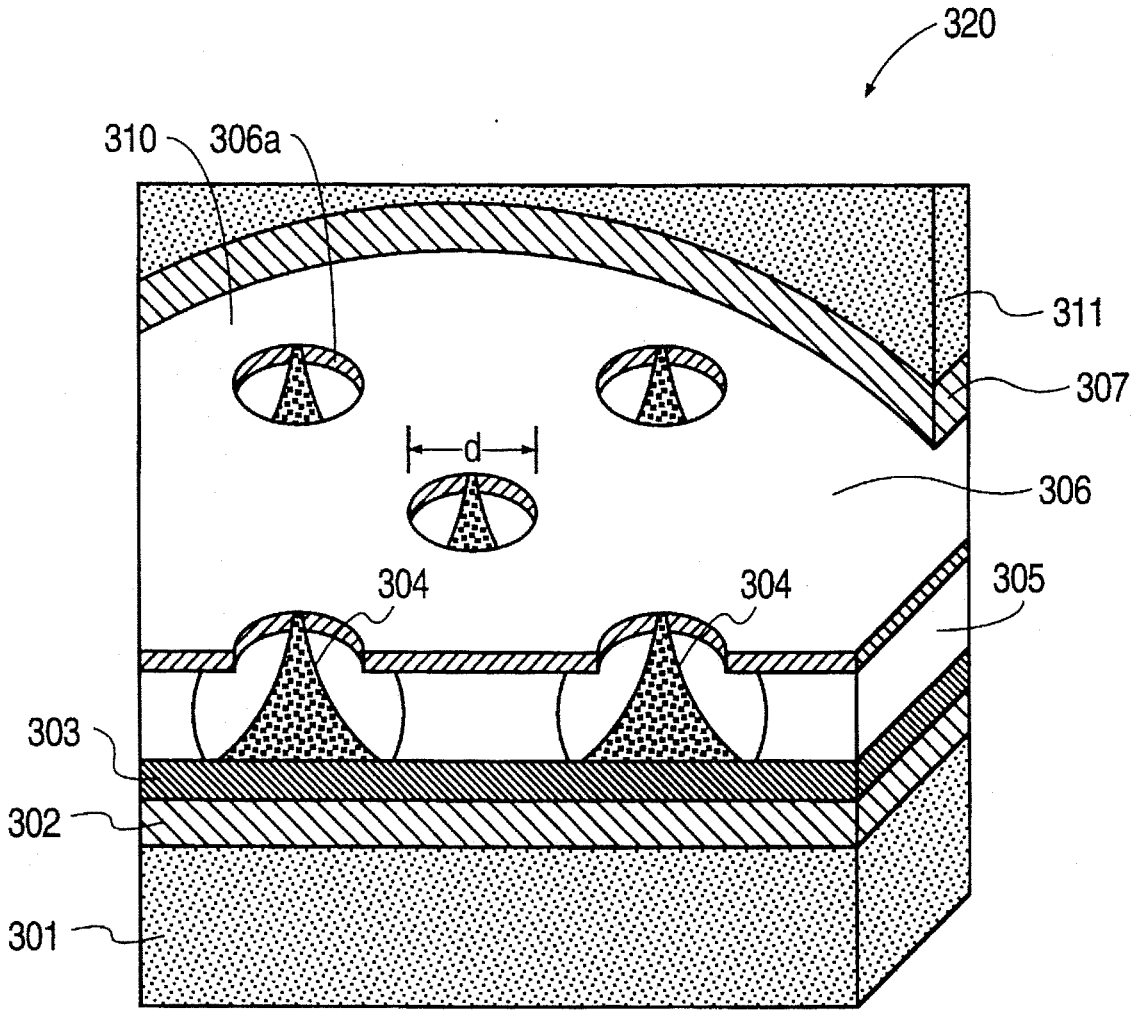
FIG. 3 shows a cutaway perspective view of a portion of a field emitter cathode according to an embodiment of the invention.

Many types of field emitters are known to those skilled in the art and could be used in emitter sets 202*a*, 202*b*, for example, cone-type emitters (Spindt cathodes) as shown in more detail in FIG. 3, emitters employing Cerment cathodes or diamond cathodes, or edge emitters. A discussion of types of field emitter cathodes can be found in an article entitled "Vacuum Micro-Electronics," by I. Brodie and C. A. Spindt, in Advances in Electrons and Electron Physics, Vol. 83. The specific structure of the emitters in emitter sets 202*a*, 202*b* is not crucial to the present invention. Preferably, the emitters employed produce a tight, uniform, and low-noise beam of electrons, produce sufficient current, have a gate-to-emitter bias voltage below 80 V, and are inexpensive to manufacture.

Emitter sets 202*a*, 202*b* can be formed on baseplate 201. Spaced apart from baseplate 201 is a faceplate 220 which is typically made of glass. Baseplate 201 and faceplate 220 are sealed together to form an enclosure. An anode 221 is on the surface (interior surface) of face plate 220 that faces baseplate 201. The interior surface of faceplate 201 also includes phosphor regions 222*a* and 222*b* which are positioned across from emitter sets 202*a* and 202*b*, respectively. The phosphor regions 222*a* and 222*b* correspond to two different color dots on the display screen. As will be appreciated from the discussion below, the two dots are in the same row but in different columns.

Between the baseplate 201 and the faceplate 220 is a grid 210. The grid 210 is supported by and is adjacent to the baseplate 201. Alternatively, the grid 210 can be separated from the baseplate 201 by spacers.

The grid 210 has a layered structure. The layer adjacent to the field emitter in this embodiment is an insulating layer 211. The size and composition of the insulating layer 211 can vary, but for the embodiment shown in FIG. 2, the insulating layer 211 is 0.020 inches (0.51 mm) thick and is made of ceramic. The insulating layer 211 is provided with holes 211*a* and 211*b* which are 0.008 inches (0.20 mm) in diameter and aligned with the emitter sets 202*a*, 202*b*.

Some of the electrons emitted by the emitter sets 202*a*, 202*b* collide with the side walls of the holes 211*a*, 211*b*. To prevent charge build-up, a resistive layer can be provided on the walls of the holes 211*a* and 211*b* to drain away charge either to the grid 210 or to the baseplate 201.

The remainder of the grid 210 can be formed by stacking layers 212, 213, 214, 215, 216, 217, 218 on top of each other, then cutting addressing holes 210*a*, 210*b* through all the layers 212, 213, 214, 215, 216, 217, 218 simultaneously. U.S. Pat. No. 5,424,605 describes in detail methods for forming grids in a flat CRT which employs a thermionic cathode instead of a field emitter cathode. Much of that discussion is repeated below. Those methods can also be used to form grids for use with field emitter cathodes, e.g., grid 210, according to the present invention. Addressing holes 210*a*, 210*b* are 0.005 inches (0.13 mm) in diameter. The geometry of addressing holes 210*a*, 210*b* can vary widely, including different sizes and different shapes such as oval, racetrack, rectangular, square, or triangular. The advantage of each hole shape may be different and may depend on the display type. For example, the racetrack shape hole allows a higher transmission through the grid (larger open area) than a round hole while allowing control voltages that are as low or lower that the round hole. Addressing holes 210*a*, 210*b* could have an expanding cross-section like a section of a cone, or a stepped pattern as illustrated in FIG. 2.

The metal layer 212 of the grid 210 is about 0.0003 inches (7.6 μm) thick and comprises a collection of electrically separated column electrodes including column electrodes 212*a*, 212*b*. The column electrodes 212*a*, 212*b* lie above the emitter sets 202*a*, 202*b* such that the addressing holes 210*a*, 210*b* pass through the column electrodes 212*a*, 212*b*. The voltage on the column electrodes 212*a*, 212*b* strongly affects the trajectory of electrons emitted from emitter sets 202*a*, 202*b* so that column electrodes 212*a*, 212*b* can switch the flow of electrons through the addressing holes 210*a*, 210*b* on and off.

There are many techniques known to those skilled in the art to form such conducting layers, e.g., metal layer 212 and electrodes, e.g., column electrodes 212*a*, 212*b*. One technique is depositing a uniform layer of metal on insulating layer 213 then shaping the metal layer by masking and etching. Another technique is screen printing of the desired patterned metal electrodes onto an insulating layer 213.

In the embodiment of FIG. 2, row electrodes (not shown) are formed on baseplate 201 as part of the field emitter cathode structure. Alternatively, the row electrodes could be formed in the grid 210. The voltages on the row electrodes and column electrodes 212*a*, 212*b* are controlled by circuitry (not shown). The emitter sets 202*a*, 202*b* are in the same row. In FIG. 2, the row electrode corresponding to the emitter sets 202*a*, 202*b* is at a voltage which causes emission of electrons. The column electrode 212*a* is at a voltage that switches "on" an electron flow to the phosphor 222*a* (i.e., electrons are allowed to pass the column electrode 212*a*), as shown by the electron paths 219*a*. The column electrode 212*b* is at a voltage that switches "off" (i.e., electrons are repelled and not allowed to pass column electrode 212*b*) the electron flow to the phosphor 222*b*.

The voltages necessary to switch the electron flow on or off depend on the geometry and characteristics of the grid 210 and emitter sets 212*a*, 212*b*. With the geometry as described above, and an 80 volt emitter-to-gate voltage, when the column electrode 212*a* is 8 V above the voltage of the emitter, electrons can flow through the addressing hole 210*a*. When the column electrode 212*b* is equal to or less than 0 V, electron flow through the addressing hole 210*b* is substantially stopped.

Electrons which are emitted from the emitter set 202*b* are stopped from flowing to the phosphor 222*b* by the voltage level of the column electrode 212*b*, and must go elsewhere. Some of the electrons are absorbed by the walls of the hole 211*b* as discussed above. Many of the electrons flow back to the gate of the emitter set 202*b*. As discussed below, the gate of the emitter set 202*b* can be provided with a resistive means so that any current that flows to the gate reduces the potential of the gate locally and thereby reduces the local gate to emitter tip bias voltage and reduces the number of electrons emitted from local emitter tips. This effect reduces the overall current emitted from the emitter set 202*a*, 202*b* during off pixel states and reduces the overall power use.

With the switching capabilities of the column electrode 212*a*, the current of electrons flowing to the phosphor 222*a* can be switched off and on to pulse width modulate the electron flow. Pulse width modulation is not practical in most prior field emitter cathode based displays emitters because the large capacitance caused by the close proximity of row and column electrodes prevents the rapid voltage changes at high frequency necessary for pulse width modulation in display applications. Pulse width modulation controls the average intensity of the light emitted by the phosphor 222*a* by controlling the number of electrons that hit the phosphor 222*a*. If the electron flow is not cut off during the entire time a pixel is being illuminated then the intensity of the pixel is brightest. If electron flow is cut off for some portion of the time then the intensity is at an intermediate value. Pulse width modulation provides the variation in intensity necessary for gray scale or multicolor images.

Formed over metal layer 212 (column electrode layer) in sequential order are an insulating layer 213, a conducting layer 214, an insulating layer 215, a conducting layer 216, an insulating layer 217, and a conducting layer 218. In FIG. 2, the insulating layers 213, 215, and 217 are made of ceramic and are approximately 0.0057 inches (0.14 mm) thick. The conducting layers are metal and approximately 0.0003 inches (7.6 μm) thick. Other thickness and materials can be used.

The conducting layers 214, 216, 218 can be patterned or unpatterned and can be used for different functions. Unpatterned layers are uniform layers of electrically conductive material. Patterned layers have patterned electrically conductive regions which are formed by etching or other well known means.

The grid shown in FIG. 2 focuses electrons in two ways. First, the addressing holes 210*a*, 211*a*, 210*b*, 211*b* provide apertures which absorb electrons at large angles to the axis of the addressing holes 210*a*, 210*b*. In order to prevent charge buildup on the walls of insulating layers of the addressing holes 210*a*, 210*b*, resistive films can be provided on the walls. A resistive film, on the order of $10^8$ ohms/□ sheet resistance for example, drains charge away before the charge builds up and affects the electric fields within the holes 210*a*, 210*b*.

Second, unpatterned conducting layers which surround a circular addressing hole and which are set to a fixed voltage provide an electric field that is cylindrically symmetric with a component toward the center of the addressing hole. The field caused by an unpatterned conducting layer can therefore be used to focus or defocus an electron beam, depending on how the electric field of the conducting layer interacts with the surrounding electric fields.

In FIG. 2, with the column electrode 211*a* at 8 V, layer 214 at 3 V, layer 216 at 20 V and layer 218 at 10 V, the electron beam is effectively focused. The exact voltages depend on the geometry of the grid used, the magnitude of the anode voltage, the magnitude of the gate to emitter voltage, the resistive coating of grid hole walls, and the emission angles of the electrons. In general, the top conducting layer, e.g., conducting layer 218 is used to decrease the strong electric field in the addressing holes 210*a*, 210*b* caused by the anode voltage. The size of the anode voltage tends to cause an electric field that over-focuses the electrons, so that off-axis electrons are not only bent toward the axis, but are bent through the axis. The voltage on the remaining layers is adjusted to cause the desired amount of bending of electrons as they pass through the grid 210.

Alternatively conducting layers 214, 216, 218 can be patterned to perform a number of functions. For example one of the conducting layers, e.g., conducting layer 214, could be patterned to provide row electrodes.

An insulating spacer 230 supports the force caused by the differential pressure between the internal vacuum pressure and the external atmospheric pressure outside the flat CRT. In FIG. 2, the spacer 230 is approximately 0.1 inches (2.54 mm) long. This is much longer than the less than 0.020 inch (0.508 mm) spacing of prior art flat CRTs which use proximity focusing, but even with the 0.1 inch (2.54 mm) spacing, the grid 210 focuses the electron beam 219*a* to 0.0025 inch (0.064 mm) diameter dot where the electron beam 219*a* strikes the phosphor 222*a*.

The 0.1 inch (2.54 mm) spacer 230 length is sufficient to support a 5 kV anode voltage without electric breakdown of the spacer 230. A 5 kV anode voltage permits use of more efficient phosphor materials, including aluminized phosphors, which is not possible with lower anode voltages. With aluminized phosphors and 5 kV anode voltage, 20 lumens/watt should be achievable. For prior art anode voltages between 300 and 700 V, a CRT might only yield 3 lumens/watt.

If higher anode voltages are required, the distance between the anode and cathode can be expanded as long as a there is a corresponding improvement in the focusing ability of grid 210.

FIG. 3 shows a detailed perspective view of an emitter set of a field emitter cathode 320 used with the invention. In FIG. 3, emitters 304 are cone-shaped. Many other types of emitters 304 could be used. As shown in FIG. 3, the emitters 304 are organized in sets at the bottom of each addressing hole 310, rather than being uniformly distributed over the entire active area of the cathode.

The emitters 304 are formed on an optional resistive layer 303 which is adjacent a conductive layer 302, which is, in turn, supported by an insulating layer 301. The emitter tips 304 sit in holes in a dielectric layer 305 formed on resistive layer 303. On top of the dielectric layer 305 is a gate layer 306. Holes 306*a* in the gate layer 306 are aligned with each of the emitter tips 304 and have diameter of about 1 micron. The curved portion of grid spacer 311 defines a portion of a hole 310. The grid spacer 311 in FIG. 3 is electrically insulating and corresponds to the layer 211 in FIG. 2.

The resistive layer 303 helps to increase the uniformity of electron emissions from the emitters 304. If one of the emitters 304 is more efficient than the other emitters 304, and the electron current from the efficient emitter 304 is greater than the emissions from the other emitters 304 then the voltage drop across the portion of resistive layer 303 beneath the efficient emitter 304 is greater. The greater voltage drop decreases the gate-to-emitter bias voltage resulting in decreased electron emissions from the more efficient emitter 304.

In the embodiment of FIG. 3, the conductive layer 302 is made up of row electrodes. Gate layer 306 is held at a constant voltage, e.g., approximately 80 V. Alternatively, the gate layer 306 is patterned to form row electrodes and the conductive layer 302 is held at a constant voltage. The row electrodes in conductive layer 302 are switched from 0 V, which allows electron emission to near 80 V to stop electron emission from the emitters 304. Even with the relatively large switching voltage for the rows, control circuitry expense is decreased relative to the prior art field emission cathodes. Cost is reduced because only the row electrodes are switched at the higher voltage, while column electrodes are switched between 0 and 8 V, and because the control circuitry which controls the row voltages need not control intensity of emission. Pulse width modulation can be used to control the intensity of light emitted from the phosphors, so the gate-to-emitter bias voltage levels need not be varied except to switch the emitters 304 on and off.

The electric field formed by the gate to emitter bias voltage is strong enough so that even at room temperature, the thermal energy of some electrons overcomes the work function of the emitters 304, and electrons are emitted. When an grid (not shown) such as grid 210 switches on the electron flow, the electrons pass through the addressing holes 310 and are accelerated by the anode-voltage to strike a phosphor. When the grid switches off the electron flow, electrons may still be emitted from the emitters 304 with an appropriate magnitude of row voltage, but the electrons never make it through the grid. If both row and column addressing is done in the grid, all of the emitters 304 in the field emitter cathode 320 are emitting electrons continually. Use of row electrodes in the field emitter cathode 320 limits the number of emitters 304 that are on at any given time to the emitters in a particular row, thereby reducing power use.

Many of the electrons emitted never hit a phosphor. Many electrons that are stopped by the grid hit the gate layer 306. If the gate layer 306 is made of a resistive material or has some other resistive means attached, the current associated with this stream of electrons decreases the bias voltage near the emitters 304. Lower bias voltage decreases electron emissions from the emitters 304. Consequently, fewer electrons hit the gate layer 306 and power loss from electrons hitting the gate layer 306 is reduced. Resistive gate films also charge up in the event of an arc or excessive current between the tip of an emitter 304 and the gate layer 306. The charge on the resistive gate layer 306 reduces emitter-to-gate current and prevents unwanted heating of the gate layer 306 and emitters 304 which may lead to failures. A resistive gate layer 306 as described is not practical in a field emission cathode which uses the gate layer to do row or column switching because the RC time constant of a resistive electrode slows down the rate of charging and discharging.

The resistive gate layer 306 can be patterned or unpatterned. A patterned resistive gate layer 306 is useful in cases where a short in one emitter 304 drops the gate voltage lowering the gate-to-emitter voltage and shutting off emissions from the surrounding emitters. The gate layer 306 can be patterned into electrically isolated regions so that only a few of the emitters 304 inside a particular addressing hole 310 use the same region of the gate layer 306. With a patterned gate layer 306, if an emitter 304 shorts or arcs to the gate layer 306, only a limited number of emitters in an addressing hole are affected.

Alternatively, a patterned conducting layer 307 can be placed in contact with the gate layer 306. The conducting layer 307 maintains a constant voltage so that a shorted or arcing emitter 304 does not affect gate voltage outside the region encompassed by the conductor. Another advantage of having conductive layer 307 on top of the resistive gate layer 306 is that the conductive layer 307 speeds up charging and discharging of the gate layer 306 and thereby prevents charge from building up.

In FIG. 3, the conductive layer 307 encircles the perimeter of the addressing hole 310 and is formed as part of the grid. The conductive layer 307 could also be formed on resistive gate layer 306, and could enclose small groups or individual emitters 304. The region of the emitter closest to the emitter tips must be resistive to obtain the advantages of the resistive gate layer.

Figure 4:
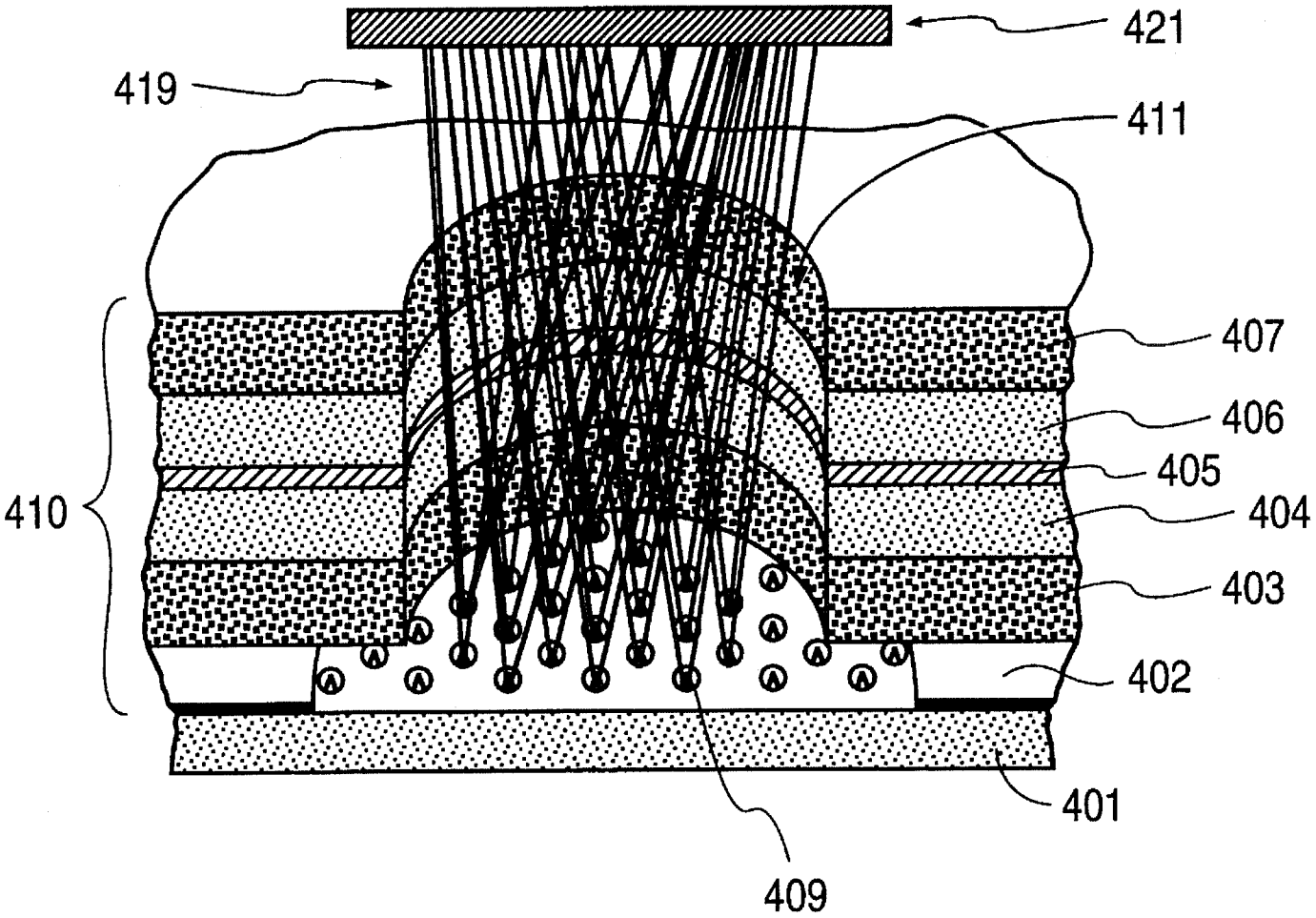
FIG. 4 shows a cross-sectional view of a grid including thick conducting layers of conductive ceramic or metal.

FIG. 4 shows another embodiment of a grid 410 according to the present invention. The grid 410 is formed on field emitter cathode 401 and includes a thin insulating layer 402, a thick conducting ceramic layer 403, an insulating layer 404, a metal conducting layer 405 which forms column electrodes, an insulating layer 406, and a thick conducting layer 407. The conducting ceramic layers 403, 407 are a mixture of ceramic, glass, and metal particles that can be purchased in large sheets. The sheets are flexible and easy to work with until hardened in a heating process. The process of forming grid 410 is disclosed in greater detail below and in application U.S. patent Ser. No. 07/867,044. Alternatively, the grid 410 can be constructed by some other means using alternating insulating and conductive layers, such as metal sheets and thick film dielectrics.

The advantage of the thick conducting layer 403 is that electrons which are absorbed by the conductive layer 403 are easily drained away by connecting the conducting layer 403 to a fixed voltage potential. With a thin insulating layer 402 and a thick conducting layer 403, the thick conducting layer 403 can be designed to absorb most of the electrons that are absorbed by the walls of the hole 411. The effects of charge build-up on the insulating layers 402, 404, 406 are reduced, enabling the use of a more resistive wall coatings. No shaping or patterning of the layer is required, so difficulties in patterning a thick conducting layer-are not a concern.

The thick conductive layer 407 has the advantage that focusing the electron beam and shielding the beam during focusing from the strong electric fields caused by the anode voltage can be accomplished by selecting an appropriate voltage and thickness for the thick conducting layer 407. Multiple thin conducting layers at different voltages can be used as an alternative to the thick conducting layer 407.

FIG. 4 illustrates another important feature of the present invention, registration of field emitters with the grid holes. In FIG. 4 emitter tips 409 are approximately evenly distributed over the area of the field emitter cathode 401. Some of the emitter tips 409 are located beneath the insulating layer 402 of the grid 410. Electrons emitted from the emitter tips 409 beneath the insulator 402 accumulate on the insulator 402. The build up of negative charge reduces the electric field near the emitter tips 409 and stops further emission of electrons from the emitter tips 409 which are beneath the insulating layer 402.

The alternative to having uniformly distributed emitter tips is to organize the emitter tips into closely spaced sets that are aligned with the grid holes. Use of zero shrinkage ceramics as discussed below makes registration between the grid and the sets of emitter tips easier to achieve.

Figure 5:
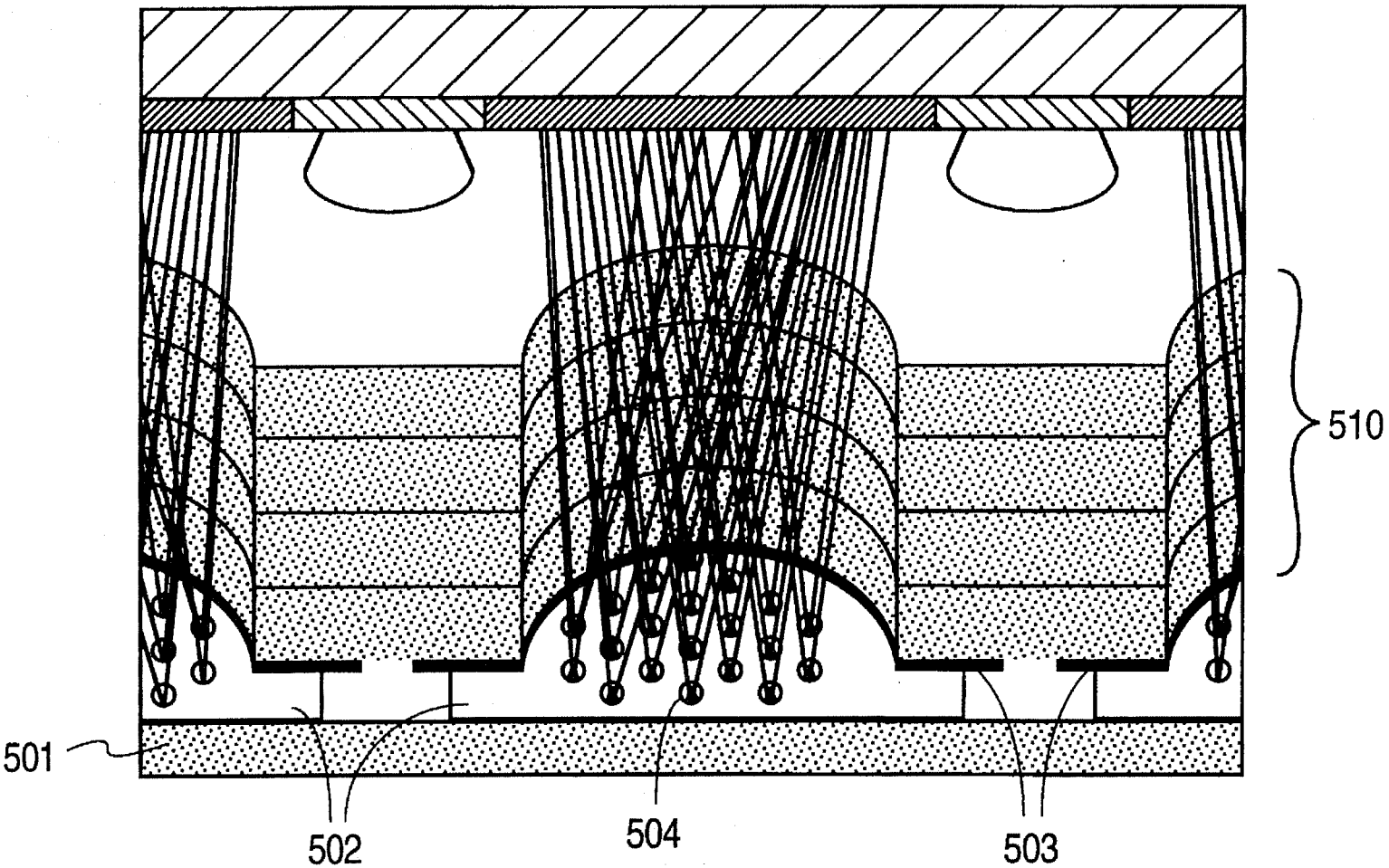
FIG. 5 shows a cross-sectional view of a grid according to an embodiment of the invention including a patterned conducting layer that serves as row electrodes and contacts for the field emitter cathode.

FIG. 5 shows another embodiment of a grid 510 according to the invention. In FIG. 5, gate film pads 502 are formed on a field emitter cathode 501. A set of emitters 504 are formed on each gate film pad 502. More generally, any pattern of conductors on the surface of the emitters can be used including pads 502 for individual emitter sets and patterns that connect two or more conductor sets. The grid 510 includes a patterned conducting layer 503 (row electrodes) formed on gate film pads 502. The row electrodes 503 are in electrical contact with the gate film pads 502. The row electrodes 503 contact control circuitry that is mounted on the grid 510. When combined with column switching in the grid 510, most of the contact from the interior of the flat CRT to control circuitry can be located on the grid 510.

Figure 6:
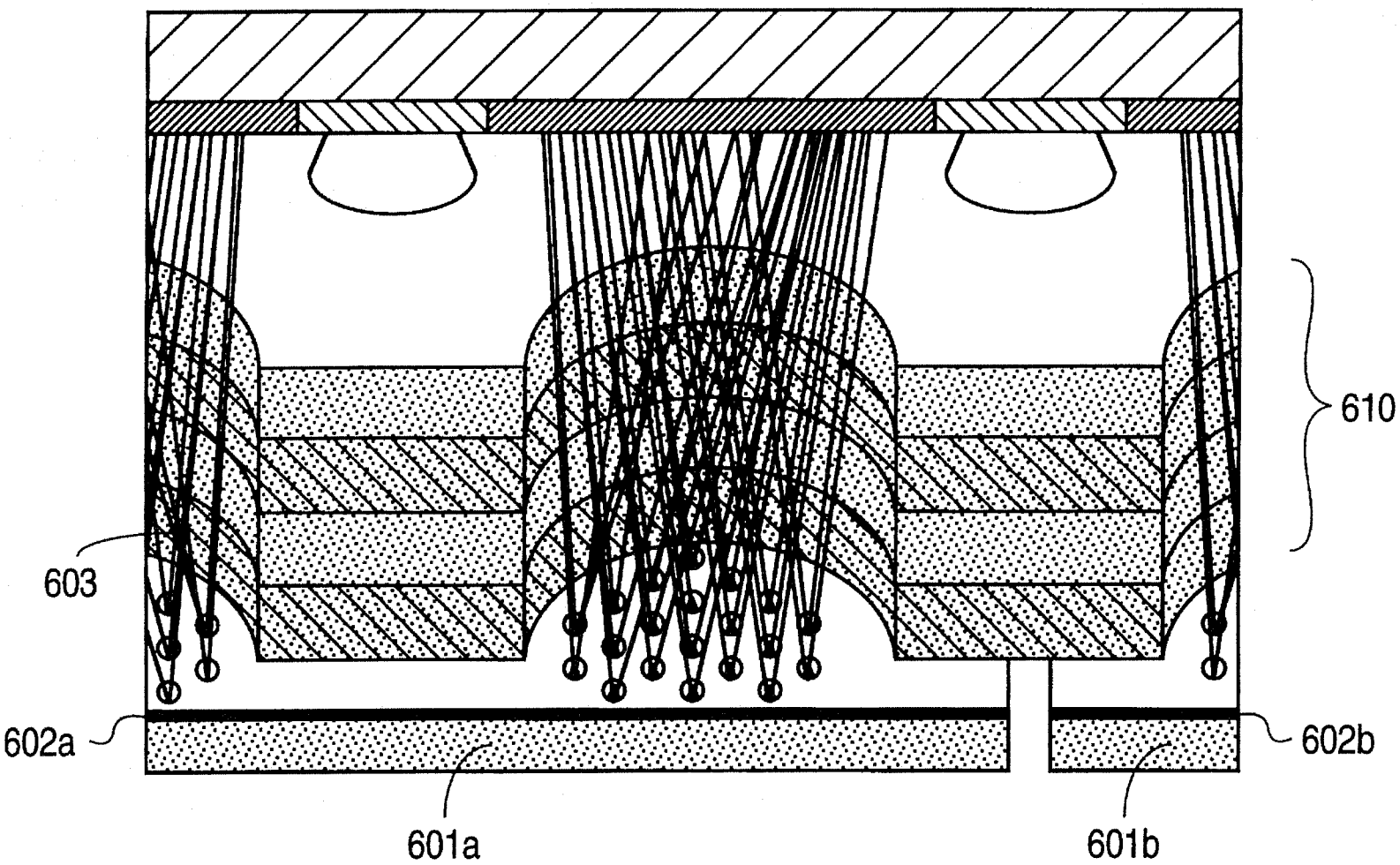
FIG. 6 shows a cross-sectional view of a grid including a patterned conducting layer to electrically connect separate emitter plates to form a field emitter cathode.

FIG. 6 shows another embodiment of the invention. In FIG. 6, a grid 610 has a conducting layer 603 which is in contact with two separate cathode plates 601*a* and 601*b*. The conducting layer 603 makes electrical connection between the cathode plates 601*a* and 601*b* so that the gate layers 602*a* and 602*b* operate as a single unit. Formation of a field emitter cathode as a number of cathode plates, e.g., cathode plates 601*a*, 601*b* (tiling) may be necessary because of difficulties in fabricating large field emitter cathodes for applications such as big screen televisions. The conductive layer 603 on the bottom of the grid 610 provides a convenient method of connecting the cathode plates 601*a*, 601*b* together.

FORMATION OF GRID STRUCTURE

FIG. 7, comprising FIGS. 7A through 7I, gives a schematic illustration of the process and formation of the multilayer grid structure 790*x* and of the cathode and anode and the ultimate assembly of these components.

A grid structure 790*x* of the CRT preferably is formed of laminated sheets 790 of vacuum/electron beam compatible low temperature glass ceramic material, with conductive metal traces 796 on surfaces of layers 790, deposited prior to lamination. In one embodiment the grid laminate 790*x* has an overall thickness of about 0.032 inch. A multiplicity of holes 744 through the glass ceramic layers 790, approximately 4 to 10 mils in diameter, are in registry in the laminated structure and form a grid. The grid allows the addressing of individual pixels by modifying the electrical field within each hole 744. The electrical field within each hole 744 is the summation of the electrical fields created by each grid element due to its position and applied voltage. The electrical field allows or forbids passage of electrons from the cathodes to the anode, and focuses or defocuses the beam of electrons. Additional holes 792 in the laminated grid structure are used for conductive vias 794, which bridge a conductive path between conductive traces 796 on one layer 790 and conductive traces 796 on different layers 790*a*–790*e*.

One example of a low temperature glass ceramic material which can very advantageously be used for the purposes of this invention is du Pont's Green Tape (trademark of du Pont). This material, available in very thin sheets (e.g. about 3 mils to 10 mils) has a relatively low firing temperature, about 900° to 1000° C., and includes plasticizers in the unfired state which provide excellent workability, particularly in the forming of tiny, closely spaced holes for the grid of the invention. The Green Tape product is a mixture of ceramic particles and amorphous glass, also in particulate form, with binders and plasticizers. See du Pont U.S. Pat. Nos. 4,820,661, 4,867,935, and 4,948,759. The material in the unfired form is adaptable to deposition of conductive metal traces 796 in a glass matrix, such as by silkscreening or other techniques. Other materials having the desired pliability in the unfired state, such as devitrifying glass tape, ceramic tape or ceramic glass tape material, and possibly amorphous glass in a flexible matrix, are also adaptable for the purposes of the invention; the term "glass ceramic" or "ceramic" is used generally herein to refer to this class of materials. Broadly speaking, the requirements of such a material are that (a) it be producible in thin layers, (b) the layers be flexible in the unfired state, (c) holes can be put in a layer or several layers together in the unfired state, (d) the holes can be filled with conductors where desired, (e) conductive traces can be put accurately on the surfaces of the unfired layers, (f) the layers can be laminated, in that they are bonded together at least on a final firing, (g) the fired structure have a coefficient of thermal expansion that can be substantially matched to that of a face plate and a back plate of preferred materials such as float glass, (h) the fired, laminated structure be rigid and strong, (i) the fired structure be vacuum compatible, (j) the fired structure not contain materials which will poison the cathode of the CRT, and (k) all materials and fabrication be possible at practical cost. While the preferred materials appear to be the class of glass ceramic materials mentioned above, other materials having these characteristics or most of these characteristics are becoming available. Polyimides, as an example, are very high temperature, high strength vacuum compatible plastics used for the fabrication of multilayer printed circuit boards in such applications as electronics used in space.

As used in the method and construction of the invention, the unfired tape layers 790 with formed holes 744, 792 and deposited metal traces 796 are laminated together at appropriate low temperatures (typically 70° C. in the case of the du Pont Green Tape product) and pressures. This step fuses the layers 790*a*–790*e* into a single unit 790*x*. The laminated layers 790*a*–790*e* are subsequently fired to burn out the binders and plasticizers from the tape (approximately 350° C. in the case of the du Pont product).

The final firing (900°–1000° C. in the case of the du Pont Green Tape product) is high enough to sinter the glass particles so that they flow together sufficiently to integrally bond the glass ceramic layers 790*a*–790*e* together. Preferably a multi-temperature firing is used, following a prescribed profile, taking the temperature from room temperature through the burnout temperature to the final temperature and back to room temperature. In this way a fused together, integral grid structure 790*x* is formed, with conductive traces 796 between the integrally bonded layers 790*a*–790*e* and extending to the edges of the structure for connection to driving electronics. Fusing occurs by glass bonding between the layers 790*a*–790*e*, in the case of the du Pont product. The integral, self-contained grid structure 790*x* is achieved with relatively low firing temperatures, and the materials and method of construction afford efficiency and economy in manufacture.

As an alternative to fusing the layers by firing as described, interlayer bonding can be achieved by diffusion bonding or crystal growth across the boundary (or a combination of these processes). In these processes, pressure is often used to assure intimate contact to facilitate the bonding process. These types of bonding can be used with materials other than glass ceramics or the family of ceramic tapes as defined herein. For example, in certain applications a pure ceramic (containing no glassy phase) might be utilized. In such applications the fusing together of the layers 790*a*–790*e* is carried out by solid state diffusion or crystal growth across the interface.

A relatively dense grid of holes 744 can be achieved in the unfired tape material 790*a*–790*e*, the integrity and spacing of which are maintained through the firing or with controlled, uniform shrinkage. For holes of 7.5 mil diameter, a density of 3460 holes per square inch has been achieved, through layers 790 of about 10 mil thickness. Holes of 4 mil diameter have been achieved at 1600 holes per square inch, through a layer about 3.5 mil thickness, which would be appropriate, for example, in a 10 inch diagonal VGA display.

In an embodiment of the invention in which a ceramic tape produced by Coors Electronic Package Co. is used, holes of 6 mil diameter having a density of 6400 holes per square inch have been achieved through 4 layers of tape having an overall thickness of 24 mils before final firing.

One preferred method for forming the holes 744, 792 uses a $CO_2$ laser to form the holes 744. The energy from the $CO_2$ laser vaporizes the local solvents and organic binders in the unfired layers 790 fast enough to blow the ceramic and glass particles out of the hole 744. This method can form very uniform holes as small as 0.005" in diameter through a 3 layer 790 laminate of tape.

Figure 8:
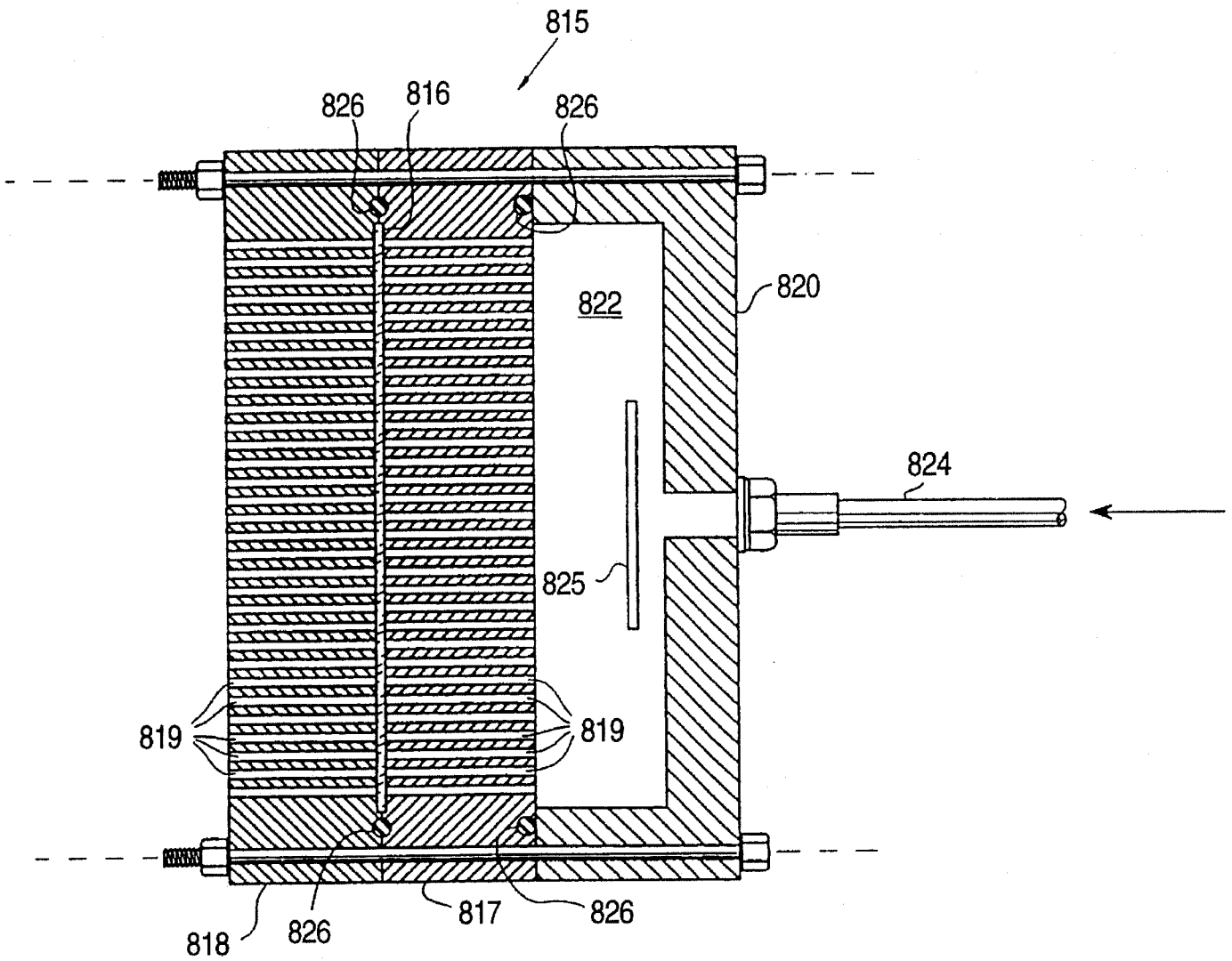
FIG. 8 is a sectional view illustrating a device for forming holes in unfired glass ceramic sheets by use of fluid pressure through a die.

Another hole formation method punches holes 744 in unfired tape 790 using compressed gas or hydraulic (fluid) pressure. In this method a single layer of the unfired ceramic tape 790 (often referred to as green tape) is placed against a die, such as shown in FIG. 8, having the pattern of the multiplicity of holes 744, 792. A similar, cooperating die may be used, with the sheet of material 790 clamped between the two dies and all of the holes 744, 792 in registry. High pressure air, other gas or liquid (which may be in a sudden burst) is used to blow plugs of material out of the unfired tape, leaving the desired grid of holes 744, 792 without distorting the remaining material. Further, after the layers 790 have been put together in an unfired laminate 790*x*, the holes 744 can be cleared, aligned and reamed to full dimension using an abrasive/fluid medium passed through the openings while the laminate 790*x* is held in a cooperative die having the desired hole pattern.

The holes 744 may be in shapes other than circular; oval, racetrack-shaped, rectangular or other shapes can be advantageous as pointed out below.

The multiple layer laminate structure 790*x* provides additional advantages. The anode and the cathode need not have any feed through, since all leads can be fed out the edges of the grid, buried within the multilayer structure and not interfering with any sealing. The voltage and current leads into the tube for cathode and anode can be conducted through a peripheral area of one layer, outside the seal, then through conductive vias 794 and transferred under the seal at subsurface levels between layers 790. Another via 794 or succession of vias 794 can bring these electrical paths back up to whatever layer is appropriate.

In another aspect of the invention, the flexible unfired glass ceramic material from which the grid laminate 790*x* is formed contains a metal oxide substance which is utilized to form a built-in surface resistance sufficient to avoid accumulation of charge on surfaces. It has been known in electron tubes to place a conductive coating such as a thin layer of titanium (formed into $TiO_x$, x typically less than 2) on insulators to keep them from charging up in operation. Various types of conductive coatings have been used for this purpose, typically applied by sputtering onto exposed surfaces. Sputtering is a line-of-sight process, so that the multiplicity of holes 744 in the grid as in this invention would be difficult to coat. A swash plate or similar arrangement might have to be used in order to assure that the conductive coating is applied on the surfaces of the holes 744 themselves. Another approach is to use ion plating which plates onto most surfaces, even non-line of sight.

An alternative to introducing any coating to the grid laminate 790*x* structure is to take advantage of a material contained in the initial glass ceramic layers which can be made to become slightly conductive in a later firing. In one form of this method, lead oxide is included in the glassy phase of the tape (du Pont's Green Tape, for example, has this component, but it can be added if not present). Upon firing in a reducing environment, some of the lead oxide reduces to lead suboxides and metallic lead. The result is a slightly conductive coating, limited to the surfaces, including the surfaces inside the holes 744, because of the controlled reducing environment and the isolation of the lead oxide based material below the surface. The process is diffusive, with $H_2$ reducing the $PbO_3$ to both sub-oxides $PbO_x$ and elemental lead, where x is 3 or less. The $H_2$ must diffuse into the ceramic to do so; thus the reduction occurs on exposed surfaces first. Processing time and temperature are used to control the resulting resistance.

In another important aspect of the present invention, the ceramic plate comprising the grid structure 790*x* provides a mounting for the integrated circuits of the electronics. The conductive traces 796 deposited on the various layers of ceramic material extend to the outer edges, beyond and beneath a seal which closes the evacuated chamber around the periphery. The conductive traces preferably are not present on the outermost layers 790*a*, 790*e* of the ceramic laminate where the seal must contact the surfaces, but only between layers 790. Sealing can be done directly over surface traces 796, but this requires materials compatibility between the sealing frit and the traces 796, requires a hermetic seal between the trace 796 and the ceramic below, and can compromise the conductivity of the traces 796. Also this limits surface area available for traces 796, limits the types of solder glass that can be used, and limits the processing cycle. Outside the vacuum tube, i.e. outside the seal in a peripheral space on the ceramic laminate, the integrated circuits are mounted and in conductive contact with the conductive trace leads, to facilitate addressing of individual pixel holes 744 in the grid 790*x*, in accordance with an incoming signal to the electronics.

Addressing of individual pixels holes 744 in the system of the invention is accomplished by establishing a threshold level of electrical field at the grid, required to prevent or to induce electron flow through addressing holes 744. Each of a series of layers 790 has conductive traces around the addressing holes 744, such as three to ten layers/interfaces with such conductive traces 744. If there are, for example, four layers 790 or interfaces with conductive traces 796 at each addressing hole, an appropriate voltage applied to all four will be required before sufficient electrical field exists to permit electrons through the hole 744. In this way, the various layers act as an AND gate, and the addressing is accomplished by encoding of groups of holes 744 and groups of pixels 744 at each layer 790 so that wiring is not required to each of the many holes 744 individually. Binary, octal or other type encoding may be used. At one level, the entire multiplicity of holes 744 may divide into only two regions; whereas many separate regions, such as four, eight or sixteen regions repeated and respectively wired together, may be present at other layers/interfaces.

Color addressing preferably is a part of this encoding. The system preferably addresses the screen by row scans, i.e. an entire row is activated simultaneously, followed by the next succeeding row below, etc. down the screen. A particular row may be selected by applying appropriate voltages to all conductive traces 796 associated with that row.

A particular hole 744 in the row is activated by activating the conductive trace or traces 796 associated with the column containing-that hole 744.

All column conductive traces 796 which are to provide information in the particular row scan will be activated simultaneously, in a preferred arrangement. Further, in this embodiment an additional layer or interface will be required to complete the ANDing of the conductive traces 796—the color information R, G or B. The system preferably uses time multiplexing of the R, G and B information, with R data put to an entire column (R, G and B) when all R holes are active, G data put to the column when G holes are active, etc. This preferred approach of multiplexing the color information reduces the drive electronics costs. If higher brightness is desired then all three colors can be driven simultaneously increasing the brightness at the cost of additional electronics (as well as more leads extending from the grid). Three separate drivers would be required for the red, green and blue data, rather than a single driver which time multiplexes input data (as column data) into one-third time divisions. In this approach each color potentially has one-third of the time of each row scan, but will normally be active less than this potential duration, with duration of each color determined by brightness prescribed for the particular pixel and color. Each color will be input to the column in order.

In other words, encoding of the individual color pixels may be accomplished by having one conductive layer 796 which provides individual addressing of each row (across) of pixels (each pixel being a triad of color dots); another conductive layer which individually addresses each column of pixels; and a third conductive layer which addresses, in columns, all red (R) as one common conductor, all green (G) as another common conductor, and all blue (B) as a third common conductor, so that R data is synchronized with R hole activation, G data with G hole activation, and B data with B hole activation. Thus, only three conductive leads extend from the RGB layer, and these three leads can be activated in accordance with a multiplexer which time division multiplexes input data by R data, G data and B data successively.

It should be pointed out that the glass ceramic tape which is used in accordance with the invention lends itself very well to providing such a multiplicity of leads from a single layer 790. The tape material is designed for hybrid circuit devices and multiple layer interconnections and therefore has been optimized for fine pitch, such as required here. Printing on unfired glass ceramic material before firing enables finer conductive trace lines to be printed, since the printing material is somewhat porous and the printed lines will not blush as they tend to on non-porous fired ceramic.

It should also be noted that the use of the low temperature glass ceramic material described in conjunction with the invention is versatile enough to allow the use of four color pixels instead of the three color pixels primarily described herein. The tape layers can vary in number from about three or four to perhaps eight to ten or more. In commercial interconnect circuit applications of this type of material, the number of layers has exceeded 50. Experimental interconnect devices have exceeded 100 layers.

A further advantage of the glass ceramic material is the ability to match its coefficient of thermal expansion to that of the face plate (preferably a glass sheet) and to the back plate. The coefficient can be selected (by formulation of the glass ceramic) such that a slight compression is put on the grid structure upon cooling after firing.

Importantly, the glass ceramic layers 790 are each thin so that a thin grid laminate 790*x* results. The limited thickness is important in that latitude in focussing of electrons through the holes 744 is enhanced by limited depth of the addressing holes 744. The contribution of the glass ceramic material (or other thin layers of glass and/or ceramic or other materials, workable in the unfired state) to this aspect is an important feature of the invention. The thickness of each layer 790 is selected to assure that the trace capacitance is within a desired range, and not so thin as to raise capacitance too high; 3 to 5 mils thickness is preferred.

Screen printing can be used to place the conductive traces 796 and is presently preferred. However, screen printing tolerances impose a practical limit on the closeness of the printed conductive traces 796 and consequently on discrimination between holes 744 of the adjacent columns. Current design limitations (design rules) in screen printing, which are approximately four mil trace/four mil spacing, limit the small screen size which can be achieved at a given resolution. Other types of printing can be used to achieve higher resolution or, as the design rules in screen printing eventually become finer, picture size for a given resolution can be reduced. However, even without improvements in the printing design rules, the construction of the invention provides a solution to this problem. In a system where each column of red, green or blue holes is to be addressed individually, requiring close spacing between adjacent traces, the conductive traces can be divided into alternate layers 790, avoiding the proximity problem. The same thing can be done for separation of whole pixel columns in another form of the invention, or the separation of row columns. An additional layer always can be interposed so that successive layers contain alternate row addressing traces or column addressing traces.

FIG. 7A indicates one of the sheets of unfired blank glass-ceramic tape 790. In FIG. 7B, the punching of via holes 792 is indicated through one or more layers of the glass ceramic material 790. This hole forming operation can be performed in accordance with a process of the invention described below with reference to FIG. 8. The via holes are distinguished from the electron addressing holes 744, preferably formed at a different stage. Via holes are formed in margin area 718 and may be formed between pixel holes 744 so as to permit interconnection of traces 796 between layers 790.

FIG. 7C indicates filling of the via holes with conductive material, forming conductive vias 794. In accordance with a preferred embodiment of the invention, the via filling is accomplished by screen printing (or other types of printing) of the conductive material into the via holes, in the known manner used for multilayer ceramic circuits. This can be done, for example, using du Pont's 6141D via filling paste.

In FIG. 7D, the depositing of the conductive traces 796 on one sheet 790 of glass-ceramic material is indicated. The trace material specified for du Pont Green type is 6142D. This is also preferably accomplished by screen printing techniques, although other types of printing may be used. A drying step may follow wherein the layers are heated sufficiently to remove the volatiles from the inks of the conductive traces. The conductive traces 796 (which will lie in different directions on different sheets of the material) are positioned in paths where the pixel holes will be located. The conductive vias 794 may also have conductive traces deposited over them on some layers. As indicated, the conductive vias 794 are located in areas outside the viewing area, i.e. outside the area having the pixel holes (although in another embodiment described below, the vias are formed between and among the pixel addressing holes so as to leave the peripheral areas free for joining screen sections.)

FIG. 7E indicates the step of forming the multiplicity of pixel holes 744 in the sheet 790 of unfired glass-ceramic material. As with the via holes 792 (FIG. 7B), this grid of very small holes may advantageously be formed in accordance with a hole-blowing process described below.

In FIG. 7F the series of layers 790 including layers 790*a*, 790*b*, 790*c*, 790*d*, 790*e* have been stacked and laminated together. The pixel holes 744 have been formed identically in each layer, so that they are in good registry in the resulting stack 790*x*. Lamination may be accomplished at this stage by a low temperature heat application, such as at about 70° C. between hot platens, with pressure. This low heat is sufficient to fuse the plasticizers together between layers, so that the layers are bound together by the plasticizers. FIG. 7F indicates conductive traces 796 running in the horizontal direction. Other traces 796*a*, 796*b*, 796*c* are indicated below, by successively cutaway layers at the lower left.

FIG. 7G represents another step according to a specific embodiment of the invention, whereby the multiplicity of holes 744, laid together in registry in the laminated stack of layers 790*x*, are treated with a flow-through of abrasive-containing fluid, preferably liquid (for example, water containing silicon carbide submil particles). This operation is conducted with a pair of opposed die plates supporting the laminated structure as explained below with reference to FIG. 8. The pumping of abrasive-containing liquid through the pattern of holes, with the die plates on either side to channel the flow, effectively reams all the holes to be sure they are the correct size and shape as desired, correcting any minor irregularities in registry among the layers, which are still plastic and unfired.

In FIG. 7H the laminated structure is fired, in a stepped or profile firing. This may be at an initial temperature of about 350° C., in which the organics are burned out, increased in a prescribed profiling mode up to about 950° C., depending on the materials.

FIG. 7I indicates the application of solder glass 798 (similar to an ink or paint) to the front and back surfaces in a peripheral rectangular pattern at the location of the seal area. After application, the solder glass is pre-glazed (as also indicated in FIG. 7I) by heating the laminated structure to a temperature high enough to burn off the binders and fuse the glass particles together, but low enough not to cause devitrification (for solder glass that devitrifies). This preglaze temperature is generally between 400° C. to 600° C. depending on the binder and solder glass used. Preglazing ensures that the binders, including organics, are cleanly burned away before the tube is sealed. This is particularly important with a high internal surface area internal to a vacuum tube such as described herein. Without preglazing, tube contamination can occur in either air or vacuum final seal due to a lack of sufficient oxygen to completely burn away the binder.

Other sealing techniques involve laser welding of metal flanges or laser welding of glass ceramic materials.

Uniform shrinkage is important in producing an addressing structure in an assembled CRT which functions properly. In particular, the pixel holes must be aligned with the appropriate phosphor dots, and in cases where the field emitter cathode is organized in to sets of microemitter, the pixel holes must be aligned with the appropriate microemitter sets. Most ceramic tapes exhibit some nonuniformity in shrinkage, but glass ceramic tape systems have been developed having high shrinkage and zero x-y shrinkage. Material such as du Pont 851U Green Tape has a shrinkage of 12% in x and y and 17% in z. If pressure is applied in z during firing then the x-y shrinkage is reduced to zero while increasing the z shrinkage. Shrinkage uniformity is the variation of the shrinkage from nominal shrinkage during the firing process. Shrinkage uniformity is defined as the variation in shrinkage from the nominal value. A 0.2% uniformity about a nominal 12% shrinkage results in the part shrinking to 87.8% to 88.2% of its original size. Thus two holes 10 inches apart in the unfired state could be located anywhere from 8.820 inches to 8.780 inches apart after firing. For 0.01% shrinkage uniformity the range for the same example would be 8.801 inches to 8.799 inches. In high shrinkage material, such as du Pont 851U, the nominal shrinkage uniformity is 0.2%. For certain display applications such as VGA or SGVA variations of this amount would not allow the grid pixel holes to align with independently formed phosphor dots. The preferred method reduces the shrinkage to thereby reduce the shrinkage variation. The desired shrinkage uniformity is 0.04% for VGA level resolution and 0.025% for SGVA resolution. By reducing the shrinkage to near zero, the shrinkage uniformity can be improved, using materials that utilize Compression during firing to control shrinkage. For higher resolutions than can be maintained with available materials or processes each grid can be used as its own mask for photo-lithographic application of the phosphor dots, thereby eliminating any misalignment between the individual pixel holes in the grid and the corresponding phosphor dot.

FIG. 8 is a sectional view indicating a method and a die for creating the multiplicity of grid holes 744 in each sheet of unfired glass ceramic material. The die, generally indicated at 815, uses fluid pressure to blow holes through the unfired, flexible glass-ceramic material of the sheets, such as indicated in FIG. 7E. A sheet of the material is placed preferably between a pair of matching dies 817 and 818, each of which has a pattern of a multiplicity of bores 819, corresponding to the desired location of the pixel holes 744 for each sheet or layer of the grid. In another embodiment only the back die 818 is used with somewhat reduced hole quality depending on tape thickness, hole size, aspect ratio, etc. A pressure chamber head 820 has a fluid plenum 822 which receives fluid pressure through a pressure inlet conduit 824, as schematically indicated in the figure. Preferably a baffle plate or other appropriate gas-dispersing structure 825 is located between the fluid inlet and the bores 819, as shown. The pressure plenum 822 is sealed against the face of the first die 817, as by an O-ring peripheral seal 826.

With the sheet of glass ceramic material clamped tightly between the dies 817 and 818 in this assembly, a sudden pulse of high pressure air, other gas or liquid is forced through the bores 819 via the plenum 822, blowing out plugs of the glass ceramic material in the desired locations for the pixel holes. The pixel holes in one specific embodiment are, for example, 4 mils in diameter and on 13.3 mil pixel triad centers. They may be in a close-packed hexagonal pattern, or a linear array of holes, slots or other shapes as desired for specific embodiments.

The thickness of the sheet of green unfired ceramic material, and especially the ratio between this thickness and the hole diameter, is an important consideration in determining the pressure necessary for forming the holes. As this thickness/diameter ratio increases, the necessary pressure rises greatly. This is also determined in part by the density of the fluid employed. Heavy gas will generally work more effectively than light gas, and liquid, with its incompressibility, can be even more effective. Experimentally it was determined, for example, that a 5 hole by 5 hole grid of 12 mil holes on 25 mil centers was easily achieved through a green glass ceramic material having a thickness of 5 mils, using helium gas at a pressure of 2000 psi.

This hole forming process can be enhanced by flash heating or exposing to chemicals such as MEK the glass ceramic material, only in the hole locations, prior to the pressure burst. The die can be used as a mask for this purpose. For example, accurate holes of 2 mils have been produced through 5 mil tape using MEK. Such treatment imposed at the hole locations increases the thickness which can be punched by the hole forming process, and can enable a laminated stack of the unfired glass ceramic layers to form the holes through all layers together. The treatment reduces the pressure required to blow out the material and improves the quality of the fabricated hole.

It should be understood that the hole-forming die 815 need not be large enough to form the holes for the entire display area in one step. The sheet of glass ceramic material may be moved to a series of different locations, all properly registered as to location relative to the die assembly 815.

It has been observed that the class of materials preferred for this invention, generically referred to herein as ceramic tapes or glass ceramic tapes, have a tendency to be of greater density toward one surface than the other. This may be due to the typical formation process wherein a tape slurry is deposited onto a plastic sheet carrier and doctor-bladed into the desired thickness. This may also be due to asymmetric evaporation of volatile materials contained in the tape slurry, i.e. the volatiles can only exit from the upper surface. This movement of solvent through the tape may also transport binder to the top surface leaving the top portion of the tape binder rich. In any event, the tape material closest to the plastic sheet carrier tends to be of somewhat greater density. Recognizing this effect or characteristic of the tape material, it has been found advantageous to form the fluid-blown holes by placing the side of the tape produced on the carrier film against the upstream side of the blowing device.

In an alternative embodiment, the initial rough through holes can be formed by a gang-punching technique or other mechanical means, then later abrasively cleared with the layers stacked together as described above.

As explained above relative to FIG. 7G, once all of the glass ceramic sheets with the formed holes have been laid together in the laminate of FIG. 7F, a fluid abrasive slurry can be forced through the hole columns through the stack of layers. This is preferably accomplished by again using the hole blowing die 815. With the laminated and unfired glass ceramic structure clamped between die parts 817 and 818, a fluid/abrasive slurry flowing at high speed through the bores 819 will effectively ream out the holes to the full desired diameter, correcting slight errors in registry among the layers.

FIGS. 9 through 13 illustrate structures for implementing encoding schemes in accordance with the invention, for reducing the number of leads required to address particular pixel holes, for reducing the number of drivers and for addressing the holes by rows and columns. Conductive traces must be activated at all layers to cause electrons to pass through a particular pixel hole. ANDing of the layers enables the number of drivers to be greatly reduced.

Figure 9:
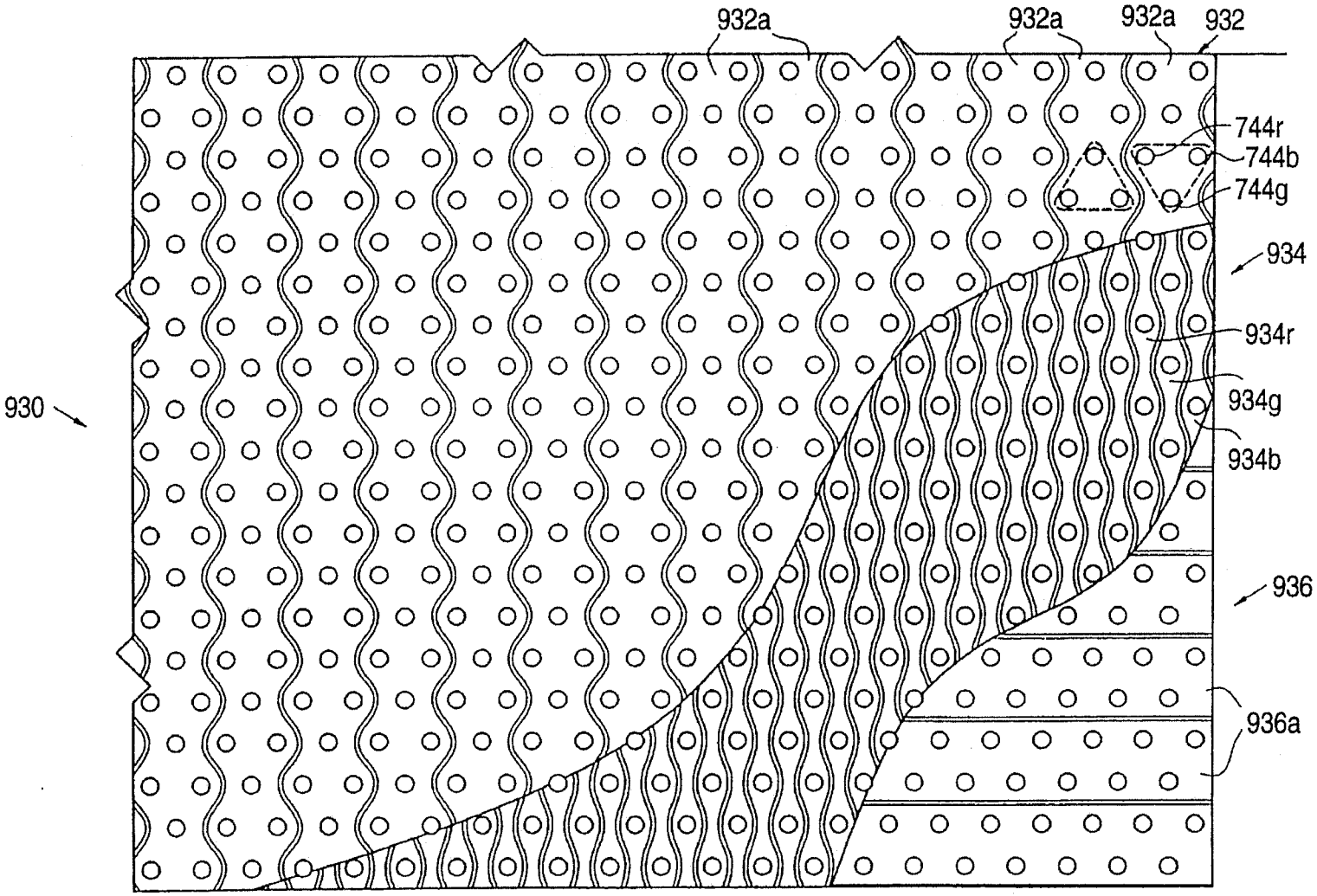
FIG. 9 is a schematic plan view illustrating electron addressing holes at different layers in a simplified grid having the simplest form of encoding of addressing holes by rows, columns and color, with conductive traces surrounding the holes at different levels.

FIG. 9 shows a portion of a three-layer laminate 930, illustrating the simplest case for a color display, without group encoding of rows and with a conductive lead required for every column and every row. ANDing is used to the extent that pixel holes are addressed by rows and columns and by the particular color (R, G or B) which must also be active for a pixel to be addressed.

As shown in FIG. 9, three glass-ceramic layers are included in this sample embodiment, an upper layer 932, a middle layer 934 and a bottom layer 936. The upper layer 932 has conductive traces 932*a* positioned around columns of holes 744 as shown, with gaps 932*b* between the conductive trace columns. As illustrated, for this color display grid there are groups of three holes 744*r*, 744*g* and 744*b* function as pixel triads in each column (example triad indicated in dashed lines). Column data is applied to the conductive traces 932*a*, preferably all columns simultaneously for a specific row, in the manner described above.

The bottom layer 936 has conductive traces 936*a* to receive row data, each row comprising a row of pixels, i.e. a row of triads of holes. Row addressing simply comprises, in the addressing scheme contemplated herein, the selecting of each row individually and sequentially down the display, in a time-divided sequence.

Figure 13:
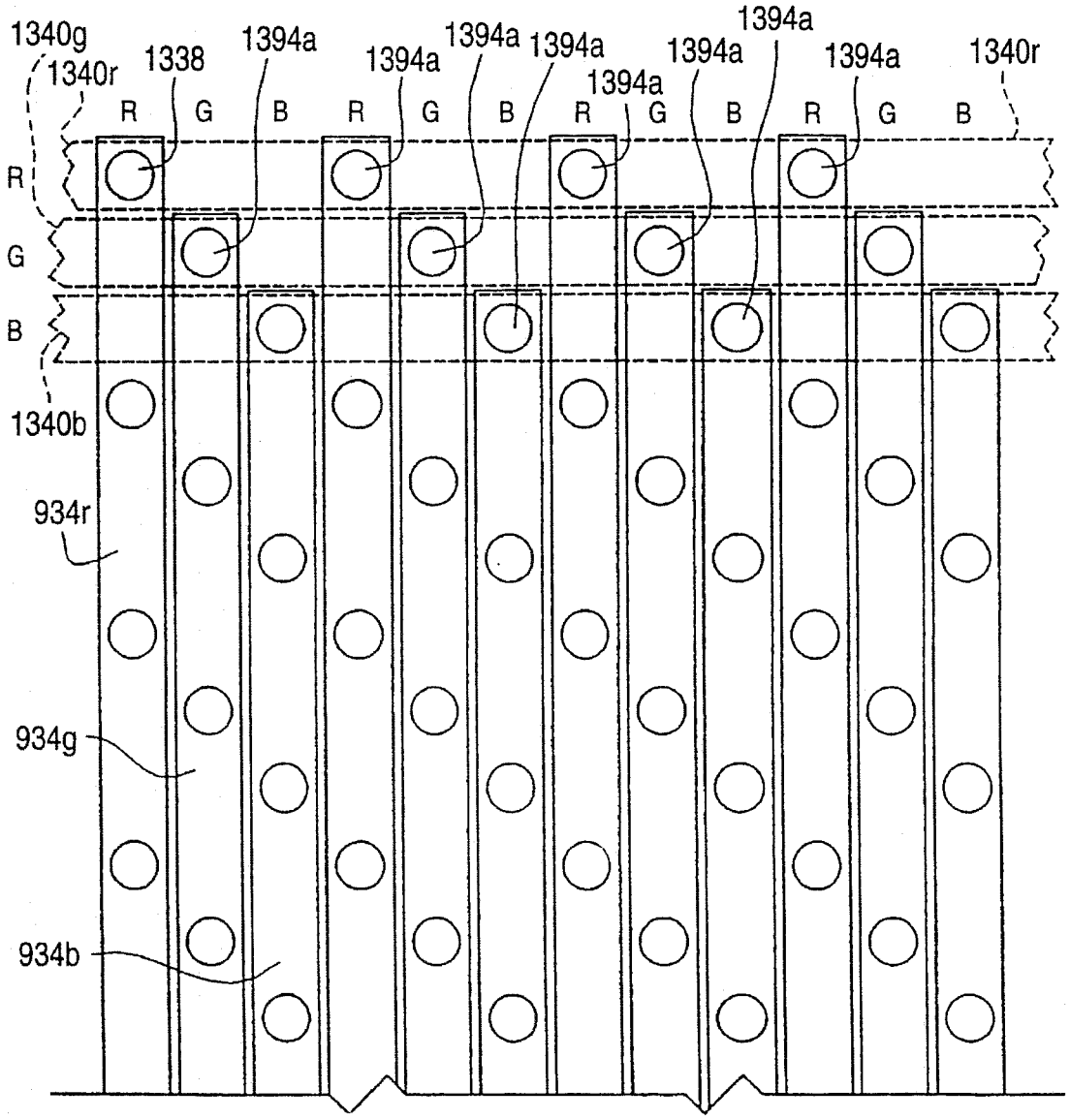
FIG. 13 is a schematic plan view illustrating an arrangement which can be used to interconnect all red pixel holes, all green pixel holes and all blue pixel holes for use in time division multiplexing of the three colors (or colors other than R, G and B if desired).

Thus, a pixel (comprising a triad of three pixel holes for color in this RGB embodiment) could be addressed uniquely by column and row. All pixels of one row can be addressed simultaneously, but with different data going to each column depending upon the input signal. To differentiate color, i.e. among the three color dots in each pixel, a preferred scheme according to the invention is to time multiplex among R, G, and B while addressing a particular row in the manner described earlier. This requires inclusion of the layer 934 in which the R, G and B holes are surrounded by conductive traces 934*r*, 934*g* and 34*b* as subcolumns, with the conductive interconnection of all R subcolumns, separately all G subcolumns and separately all B subcolumns. FIG. 13 shows an arrangement for accomplishing this interconnection, using conductive vias 1394*a* for interconnection of R subcolumns, with a conductive trace 1340*r* serving as a connecting bar at a different level in the laminated assembly (the connective trace 1340*r* could be on the same layer as the illustrated subcolumn traces for one color, since this will not involve crossing any other subcolumn traces). Similarly, all G subcolumn conductive traces can be connected by a conductive trace 1340*g* at another level, and the B subcolumn conductive traces 934*b*, via a conductive trace 1340*b* below. The connecting bars 1340*r*, 1340*g* and 1340*b* can all be at a single level and that level can be either above or below the location of the subcolumn conductive traces.

Thus, with the arrangement shown only three leads are necessary from the color select layer 934 and one lead for each column on the column trace layer 932. However, on the row trace layer 936 in this simplified example a conductive lead is necessary for each individual row. Row encoding can reduce the number of leads by employing more layers as explained below.

It should also be understood that, if it is desired to maximize brightness in the display as discussed above, R data, G data and B data can be sent to the pixel holes simultaneously rather than by time division multiplexing. This will involve essentially eliminating the pixel column layer 932 and addressing the R, G and B subcolumns of the layer 934 individually, without connecting the colors together as in FIG. 13. Only the layers 934 and 936 are involved. Thus, the time duration of activation of each pixel hole is tripled, tripling brightness. However, the number of column leads is tripled, thereby tripling the number of drivers required since R, G and B data is being sent simultaneously.

Figure 12:
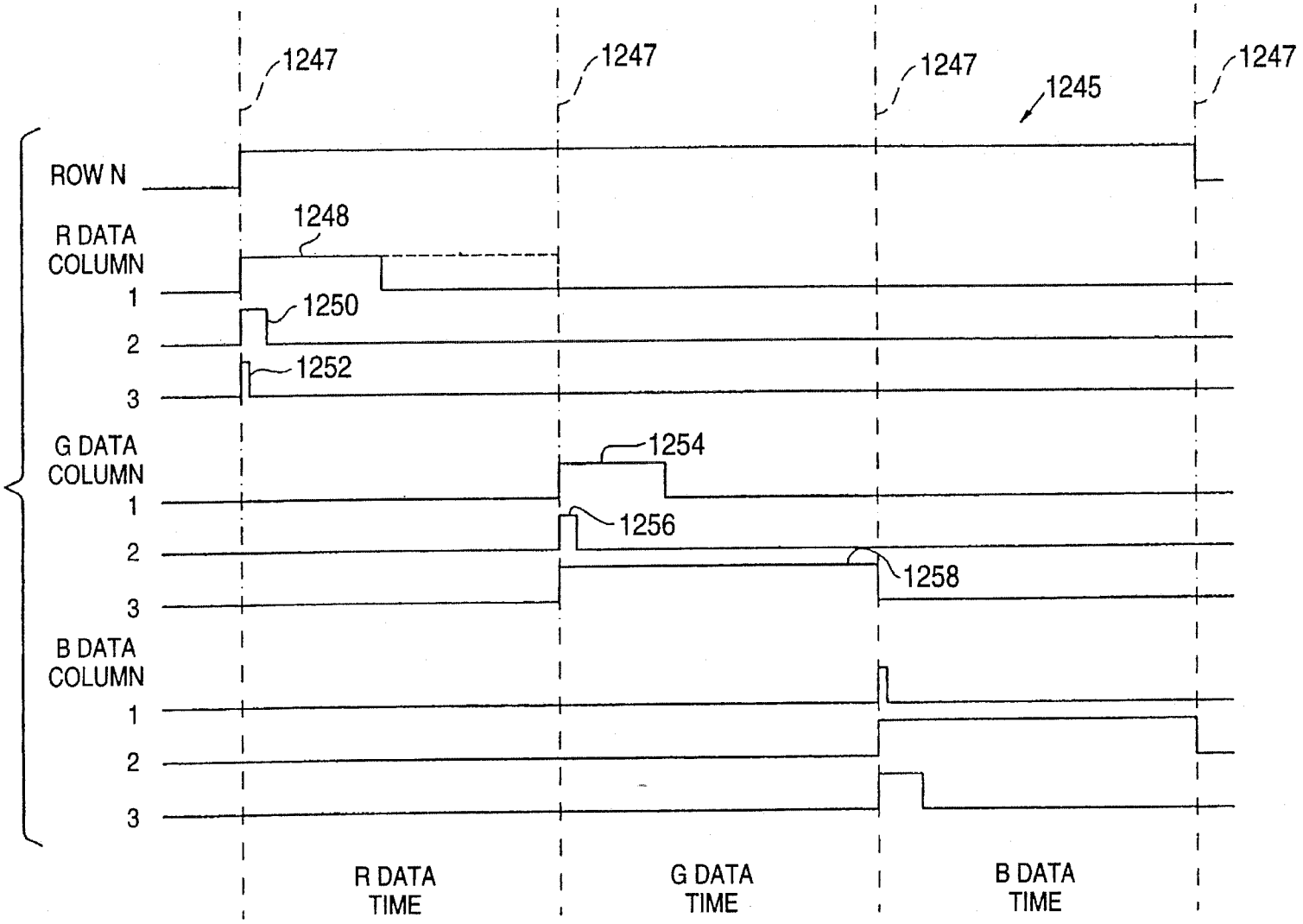
FIG. 12 is a schematic diagram illustrating color timing sequencing in accordance with one embodiment of the invention wherein time division multiplexing is used.

FIG. 12 is a simplified timing signal diagram for a color display grid. The diagram indicates that the entire row, Row N in this example, is activated for certain unit of time (for example, 1/30 second). This interval is indicated at 1245. The drawing indicates column data being applied, with time division between R, G and B data. Column data can be applied with R data from maximum potential interval 1246 (dashed lines) which is equal to one-third of the total row interval 1245. Dashed lines 1247 show the division of the interval 1245 into thirds. Examples are indicated in which, for columns 1, 2 and 3, R data is applied for respective intervals 1248, 1250 and 1252. These intervals depend on the brightness specified for the R dot in each pixel of the row.

G column data is shown being applied for potentially the next one-third of the total row duration 1245, with different G intervals 1254, 1256 and 1258 being applied for the example pixels (columns) 1, 2 and 3. B data is applied for the remaining one third of the row interval 1245, in the manner described for R and G data.

Figure 10:
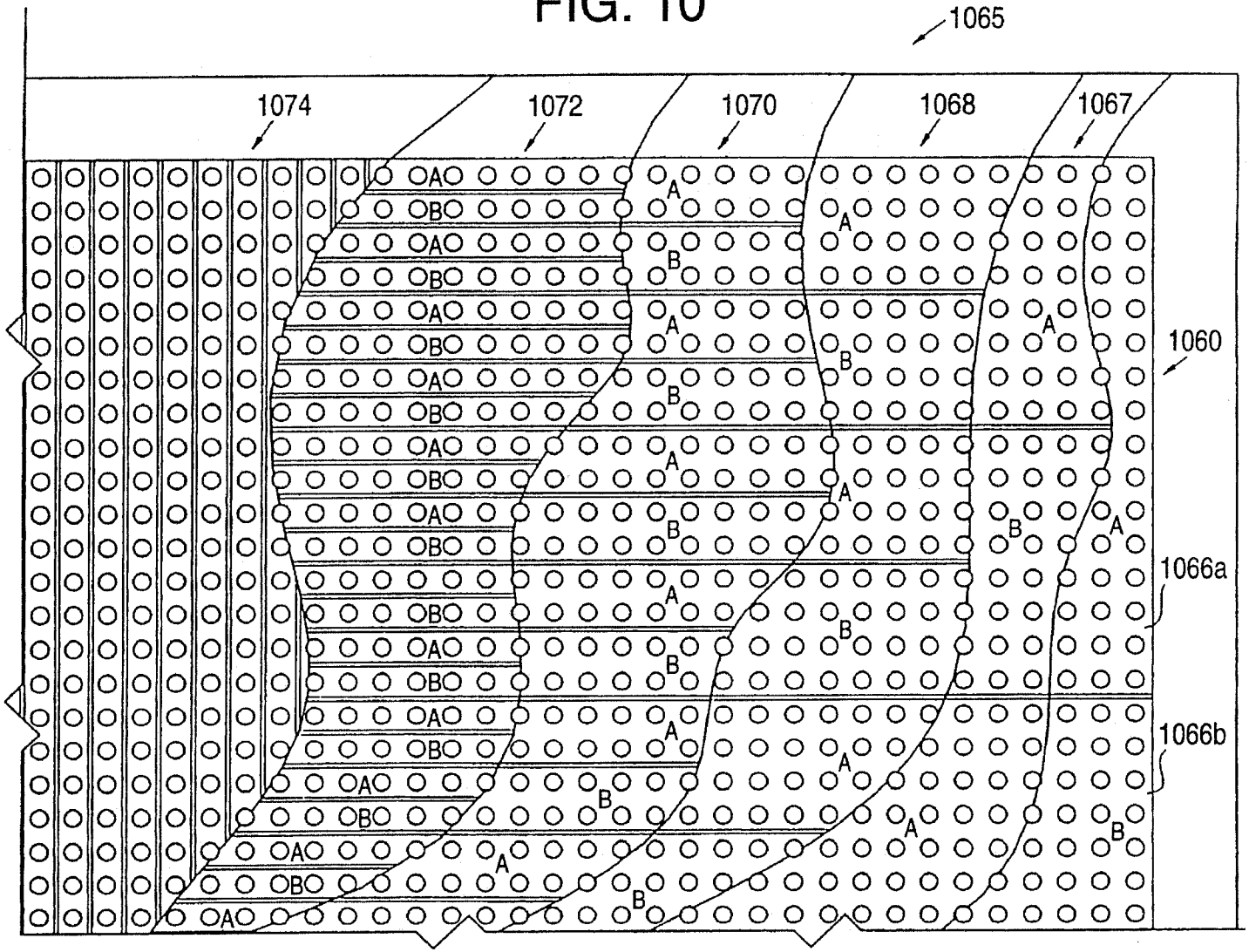
FIG. 10 is another schematic diagram showing a ceramic grid formed of a stack of layers, with the layers serially broken away to show a system of encoding for a monochrome display.

FIG. 10 illustrates an example of row encoding. For the simplified situation of a monochrome display, binary encoding is advantageously employed; however, quaternary or octal or 16 division or higher encoding can be used to reduce the number of layers if desired.

In the monochrome addressing grid 1065, columns of single dot pixels are addressed individually. Column data could be encoded in a manner similar to the encoding of row data, but this would eliminate the ability to address all pixels in a row simultaneously.

Encoding is achieved by ANDing of a series of layers 1066, 1067, 1068, 1070, 1072 and 1074, the latter being the column data layer. In the binary encoding illustrated, a single conductive trace 1066*a* surrounds all the A pixel holes on the layer 1066 as shown, while a single conductive trace 1066*b* surrounds all the pixel holes in the second half of the display area or B area.

On the next layer 1067, the first area (over or under 1066*a*) is divided into A and B and the second area (over or under 1066*b*) is also divided into A and B sections. The layer is thus divided into four quarters, with the A conductive traces wired together and the B conductive traces wired together (connections not shown). At the next level 1068, each section is further divided into an A and B section, and again all A traces at this level are wired together and all B traces at this level are wired together (connections not shown).

At the conductive trace level 1070 the sections are again divided, now with 16 different rows of traces, again dividing the sections of the layer immediately above/below each into A and B sections. A further division is shown at the next layer 1072. In this schematic illustration the layer 1072 is shown divided down to the individual pixels, but in practice there will be many times the 32 rows illustrated, requiring several more layers. The required number of layers can be reduced by the use of higher order encoding division on some layers, such as quaternary, octal or 16-lead division. This encoding has the additional advantage of reducing the capacitance per division. This is desirable to insure the required drive current is within low cost driver capability.

Accordingly, for the five encoding row layers illustrated in FIG. 10, only two leads emerge from each layer, an A lead and a B lead. The A traces of a particular layer are connected together by conductive vias and traces at another level (not shown), in the manner described above in reference to FIG. 13, for example.

If the row traces receive a signal consisting of AAAAB, for example (for the layers 1066, 1068, 1067, 1070 and 1072, respectively), this will activate the second row from the top in FIG. 10. If the signal is BABBA, this will activate the lowermost row seen in FIG. 10.

Figure 11A:
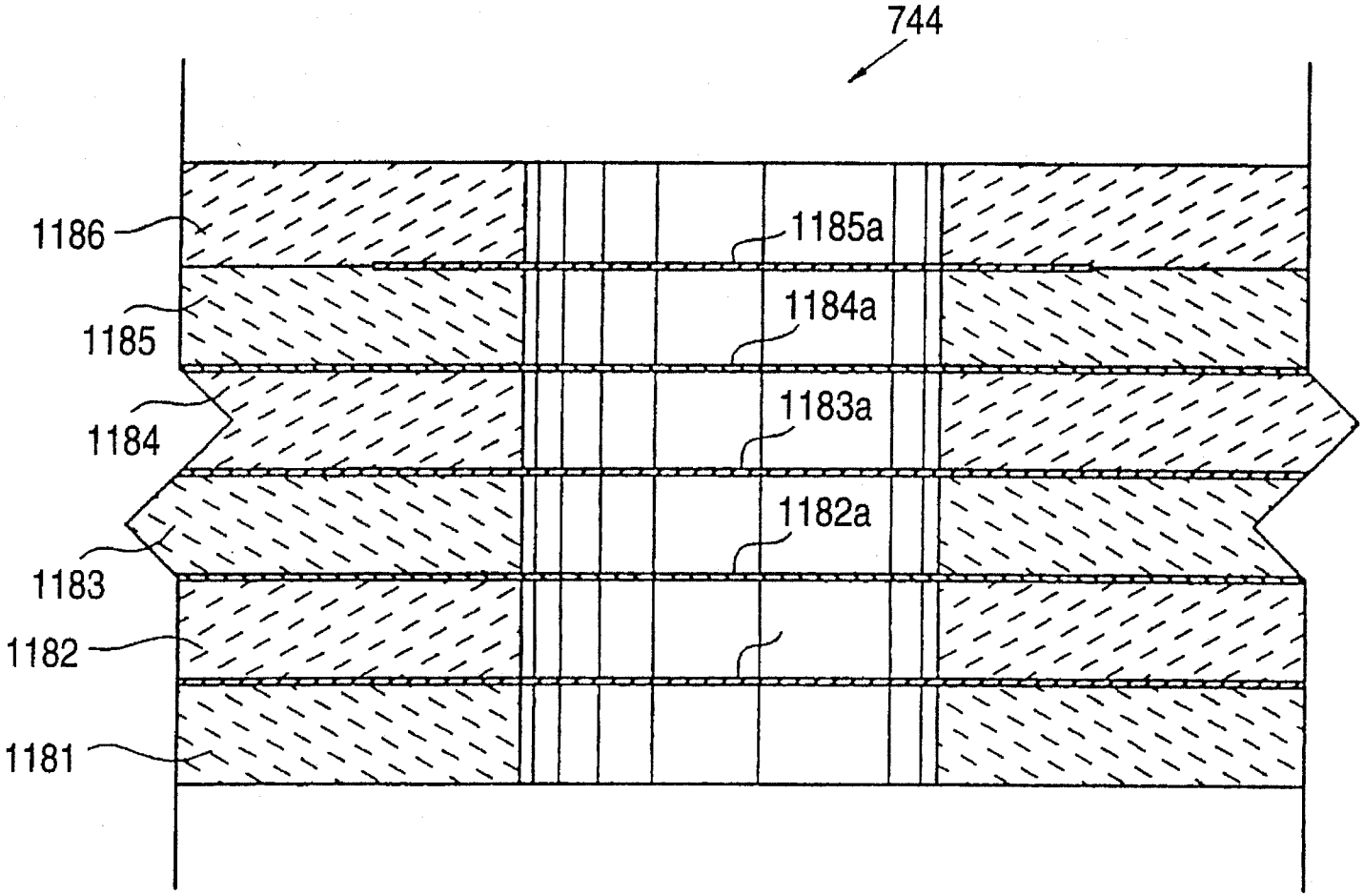
FIG. 11A is an enlarged sectional schematic view showing a single pixel hole in the grid, and indicating a series of levels of conductive traces.

FIG. 11A is a schematic, greatly enlarged cross section of a portion of an addressing grid according to the invention, showing six layers 1181 through 1186, and the interlayer conductive traces which form rings around the pixel hole 744. In this example conductive traces 1181*a*, 1182*a*, 1183*a*, 1184*a* and 1185*a* are shown only between layers, but as discussed above, the traces can be applied at either of the top and bottom surfaces of the grid assembly. The traces closest to the cathode experience a lower cut-off voltage, the voltage necessary to repel all electrons, than the traces closest to the anode. The power required to charge a given trace is $P=i^2R$ where i is the required current and R is the trace resistance. The required current, i, is given by CV/t, where C is the trace capacitance, V is the desired voltage and t is the time to charge the trace. For a given charge time, capacitance, and resistance, the power goes as the square of the required voltage. It is therefore important that the fastest changing signals be applied to the traces closest to the cathode where the required voltage is lowest and the necessary power is thus minimized. The lowest conductive traces 1181*a* can be for column data, as in the traces 1074 of the monochrome example of FIG. 10. The next four layers above can carry four levels of row encoding, i.e. at the traces 1182*a*, 1183*a*, 1184*a* and 1185*a*. The encoding which requires the fastest switching should be done at the lowest voltage as indicated above. Thus, if binary encoding is used (as in FIG. 10), the top level row encoding, at the traces 1185*a*, should have the fewest traces (e.g. only two as in FIG. 10). It should be understood that grey code techniques (which are well known) can be used to further reduce the power required in switching the addressing grid. Grey code techniques reduce the number of layers of conductive traces which must be changed in transitioning from one row to another.

The power usage in driving the traces within the grid comes from charging traces up to the required voltage, not from discharging the traces. Grey code minimizes the number of transitions in encoding levels, thereby minimizing the required power. Grey codes are no more difficult to mechanically encode in the multilayer ceramic than any other encoding scheme, such as the discussed binary encoding, octal encoding, etc.

In order to minimize the required switching voltage at the layer closest to the anode, conductive traces or a sheet-like conductive layer can be placed on the top surface of the upper layer 1186, or this conductive layer can be below the top surface (traces not shown in FIG. 11A). Such a conductive layer, located as the closest conductive layer to the anode, shields the switching region from electric fields produced by the anode voltage. This also will further modify the field lines inside the addressing holes 744, to reduce the voltage necessary to turn on and off the gate. This is important in that, in some configurations, a relatively high switching voltage is required to switch the last element of the addressing hole gate, i.e. the uppermost conductive trace 1185*a* shown in FIG. 11A.

Figure 11B:
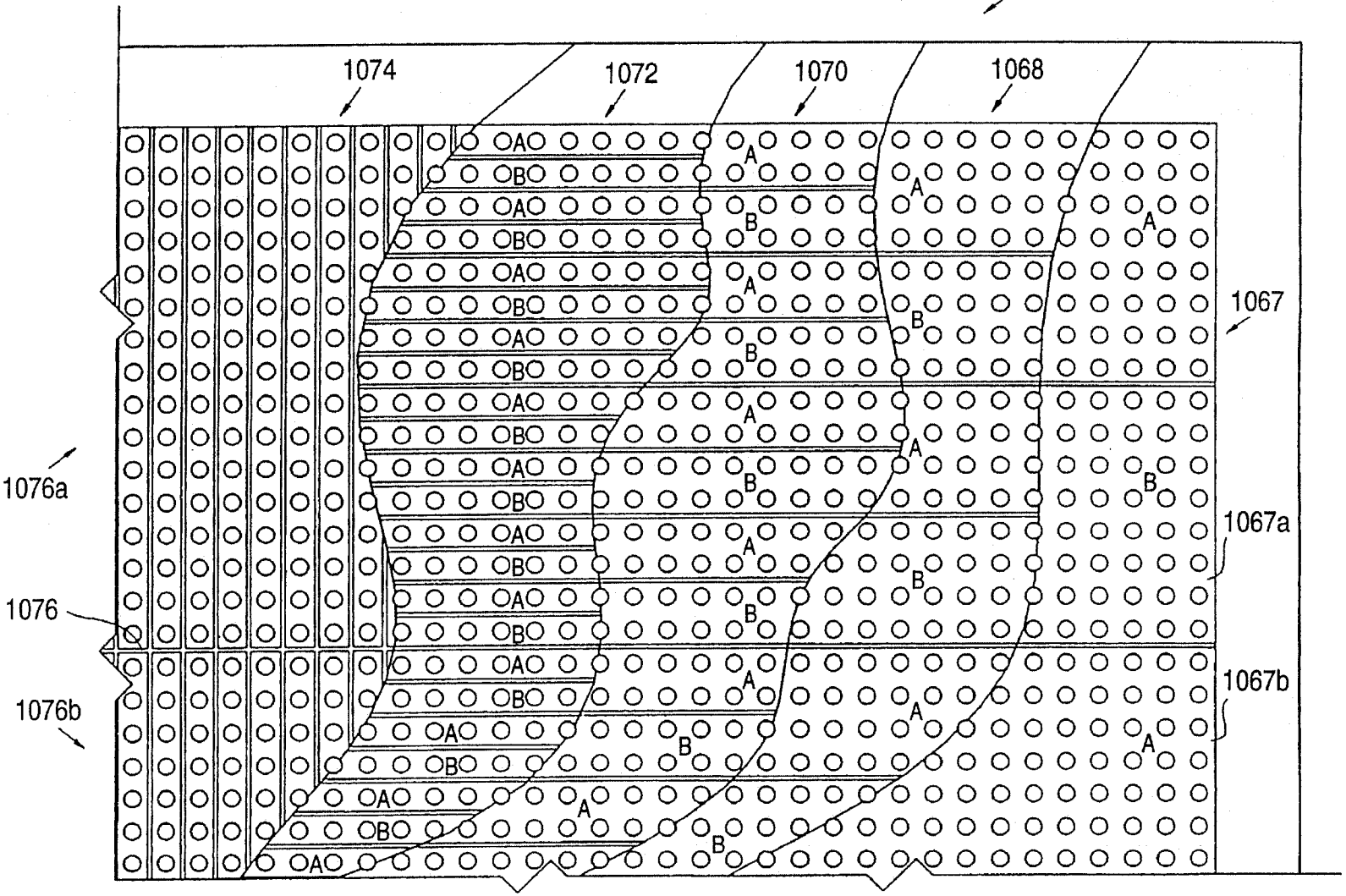
FIG. 11B is a view similar to FIG. 10, showing an alternative embodiment by which brightness of the display can be doubled.

FIG. 11B shows an alternative embodiment of an encoded grid structure 1065*a* by which brightness of the display can be doubled through activating two rows of pixels at a time. For simplicity the display is shown as monochrome, with the addressing holes in simple orthogonal rows and columns, but it should be understood that this arrangement is particularly advantageous in a color display, where brightness is more often critical. By the arrangement shown, the addressing grid is divided in half at a horizontal dividing line 1076 at which the column traces are discontinuous. The top half, 1076*a*, and the bottom half, 1076*b*, of each column are fed different data, simultaneously. The top row of pixels of the top half, 1076*a*, is preferably activated at the same time as the top row of pixels of the lower half, 1076*b*. Thus, two parallel horizontal lines are traced down the screen simultaneously, and brightness is doubled.

For row encoding in this embodiment (or an equivalent color embodiment), one fewer layer is required as compared to the embodiment described relative to FIG. 10. The layer 1067 is thus the row layer with fewest traces, shown with four traces A, B, A, B in this example binary encoding embodiment. The active rows are operated simultaneously and in parallel, so that when the uppermost row of the top half is addressed by AAAA, the lower half is also addressed by AAAA. This arrangement requires an additional set of drivers for the second set of columns. As noted above, each column in a row receives different data at one time, and in the doubled-brightness embodiment, each column receives two sets of data, an upper set and a lower set.

It should be understood that this brightness-doubling arrangement can be used with other possible arrangements for increasing brightness. For example, as explained elsewhere herein, the individual colors (such as R, G and B) can be activated at the same time, rather than through time division. This also requires additional drivers, but in those specialized applications where necessary, the change in color driving can increase brightness by a factor of three. Coupled with the double row driving (which can alternatively be triple, quadruple, etc. row driving), brightness can be increased by a factor of six.

Figure 14A:
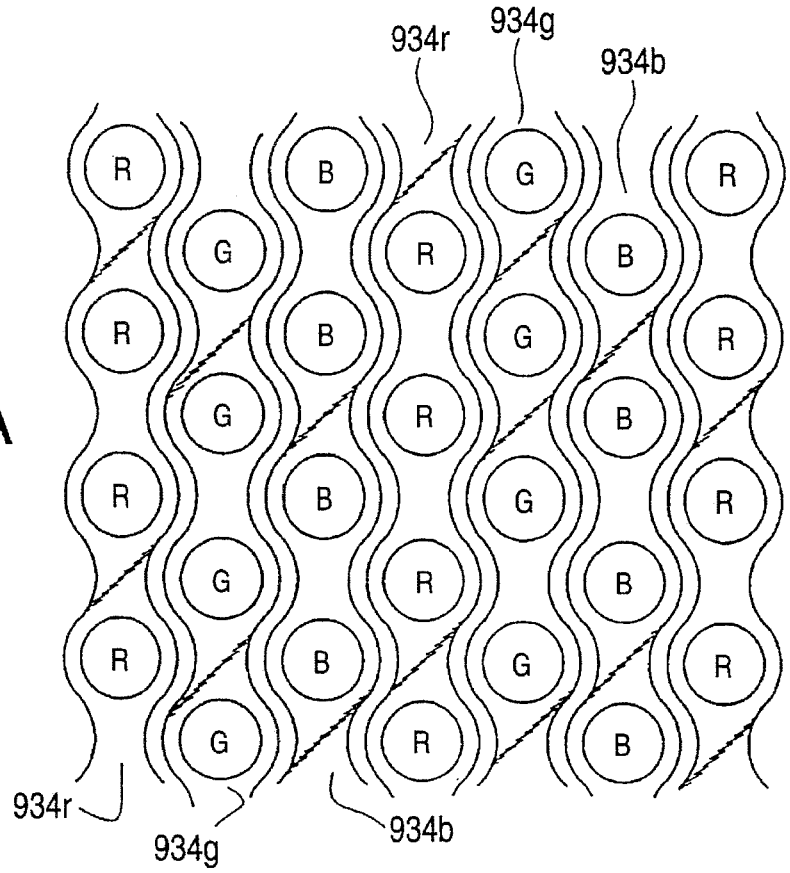
FIG. 14A is a schematic plan view illustrating the use of printing configurations to form conductive traces around grid holes and illustrating problems of proximity.
Figure 14B:
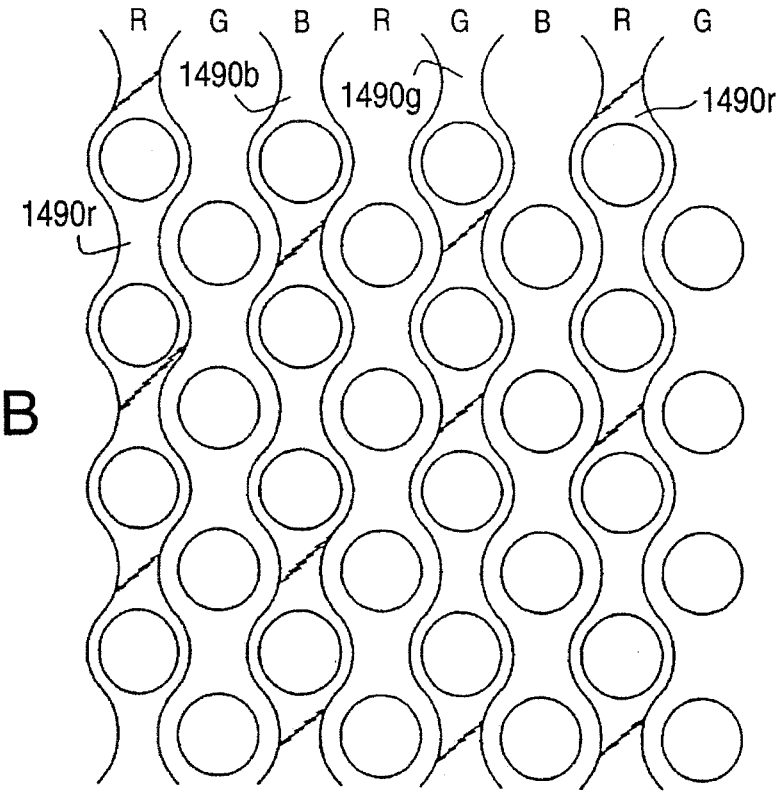
FIG. 14B is a view similar to FIG. 14A, showing an alternative arrangement for placing conductive traces, in a way to avoid problems with trace proximity by using additional layers.

FIGS. 14A and 14B show alternatives for forming conductive traces around pixel holes, depending on density required. As noted above, screen printing techniques are limited in accuracy and resolution. For high definition television displays which are relatively small in size, conductive traces 934*r*, 934*g* and 934*b* become very close together and limits may be reached as to accuracy of very fine widths of the traces and of the spaces between them. In FIG. 14A the traces are illustrated side by side, with color subcolumns R, G, B, R, G, B occurring in succession. However, an alternative made possible by the multilayer addressing grid structure of the invention is to place R traces alone on one layer (not shown). G traces and B traces (not shown) are on different layers, and, as described above, all R traces can be interconnected, as well as all G traces and all B traces. In this case the R traces can be connected directly at the same level, since no G traces or B traces will be crossed, and the case is similar with the G traces and B traces.

Another alternative, illustrated in FIG. 14*b*, is to alternate by locating every second subcolumn of conductive traces on a given layer. This will require two layers for R, G and B color selection, rather than three. Such an arrangement requires traces for all three colors to appear on each of the two layers, but the Rs are easily interconnected by conductive vias and traces, and the same with the Gs and Bs. Thus, FIG. 14*b* shows a layer with an R trace 190*r*, no trace at the adjacent G subcolumn, then a B trace 190*b*. The R subcolumn is then skipped, and next appears a G trace 190*g*. Each of two layers thus has R, G and B traces.

Figure 15:
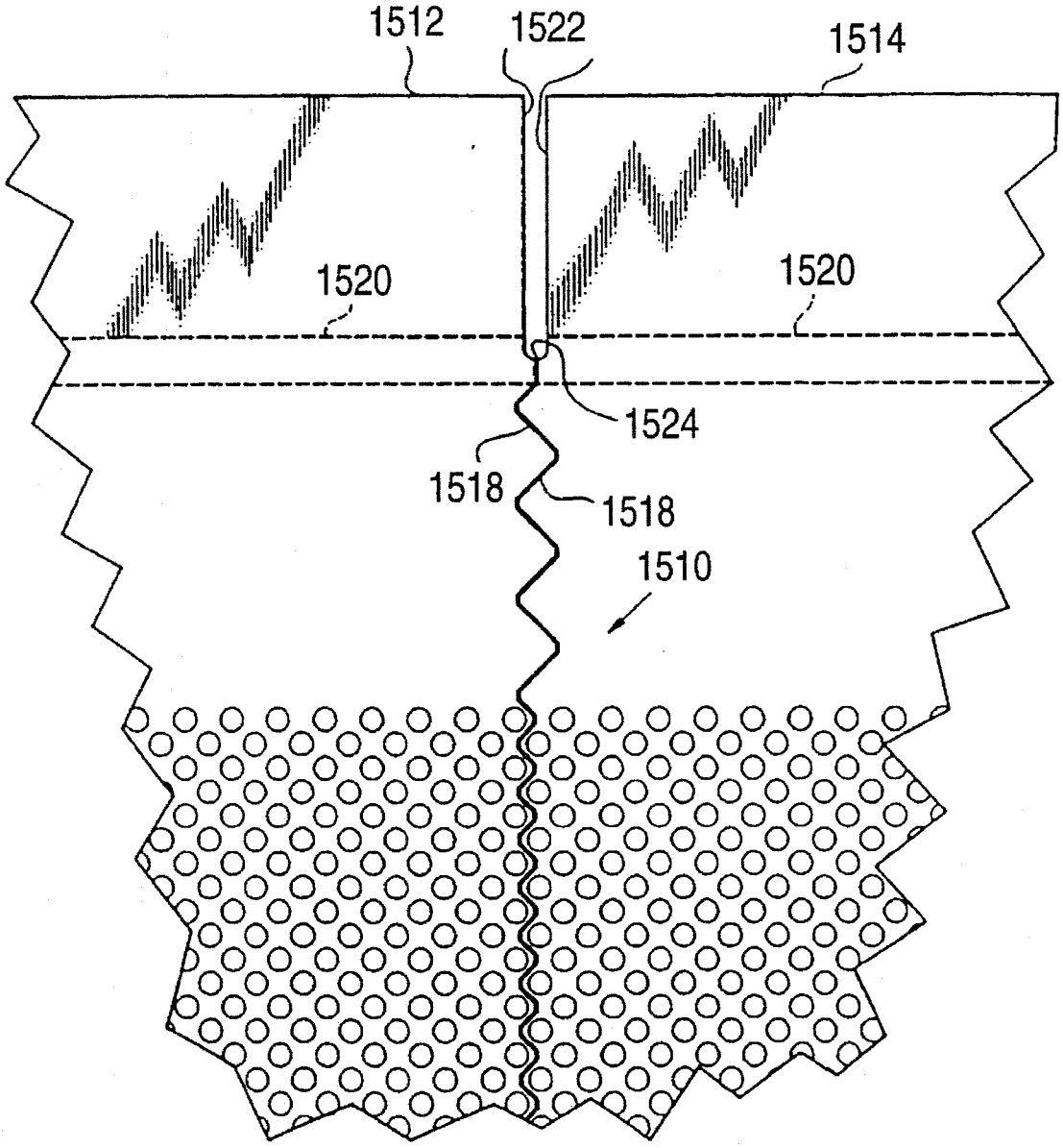
FIG. 15 is an enlarged, schematic sectional view showing a structure arrangement for assembling two modular grid sections together in proper registry, and for forming a seal in a peripheral area.

FIG. 15 shows schematically, in a partial sectional view, a juncture or joint 1510 between a pair of addressing grid modules 1512 and 1514. An overall plan view of a modular addressing grid structure 1516 formed in this way is shown in FIG. 16.

As shown in FIG. 15, the edges of each addressing grid module 1512 and 1514 preferably have notched or serrated areas 1518, for assuring proper registry between the modules and the rows of the addressing grid upon assembly. The seal area 1520, which extends around the pair of assembled modules near their periphery, is notched by a recess or notch 1522, formed on each module and extending from the exterior edge to a position 1524 which is within the band defined by the seal area 1520. This notching provides a means for application of the glass frit sealing material not only to the upper surfaces of the modules for sealing to the anode and back plate, but also for direct application to the facing surfaces where the two modules 1512 and 1514 meet at the edge, within the notch (perpendicular to plane of FIG. 15). In this way a secure seal is assured between the facing surfaces.

Figure 16:
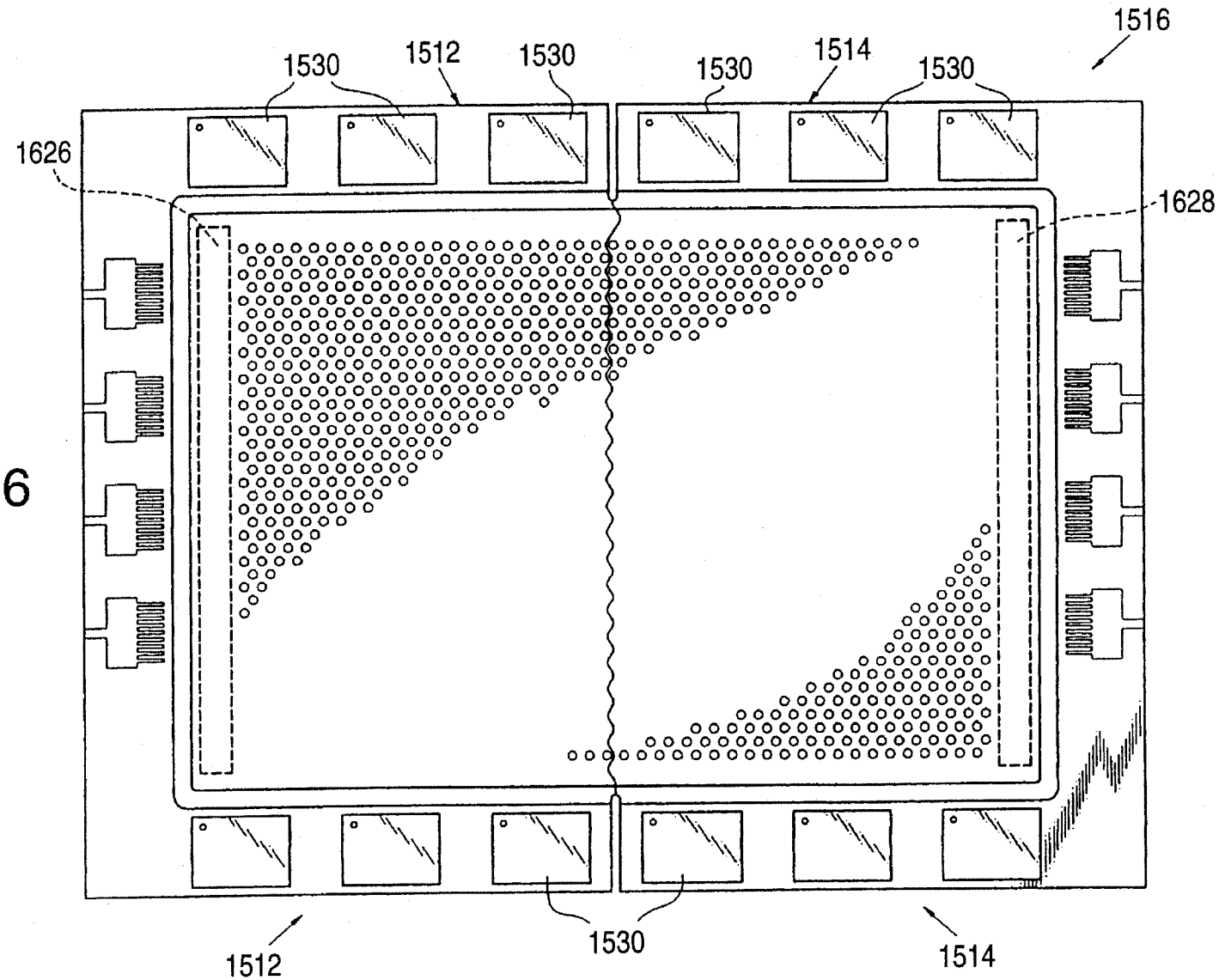
FIG. 16 is a schematic plan view showing a pair of grid modules assembled together in side by side relationship, comprising a pair of end modules.

FIG. 16 shows that the two end type modules 1512 and 1514 still leave space for transfer areas 1626 and 1628 at left and right, one on each module 1512 and 1514. In this modular arrangement, drivers 1530 handle the addressing of pixels on each respective side of the assembly, with these two sets of drivers appropriately synchronized.

It should be noted that the flexibility in design afforded by the multilayer grid allows the modules to be constructed so that no traces need to cross between the mating modules. In this way the modules need only align mechanically.

Figure 17:
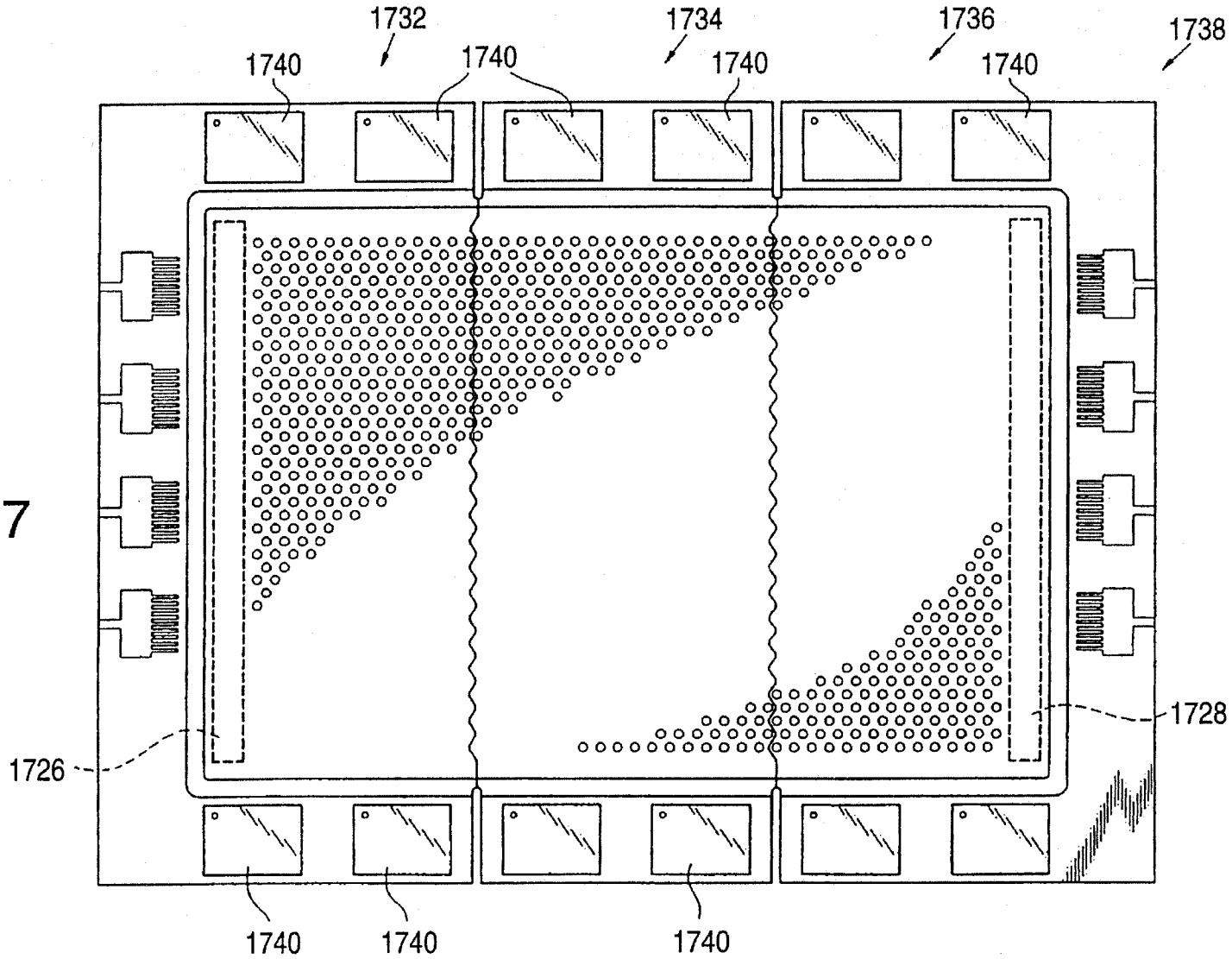
FIG. 17 is a plan view similar to FIG. 16, but showing three modules assembled together, two end modules and a center module, involving different trace routing considerations.

FIG. 17 shows a series of modules, illustrated as three modules 1732, 1734 and 1736, making up a display. In this case, as in all modular assemblies with three modules or more, the center module 1734 has no left and right margins for location of trace transfers to the periphery of the display assembly 1738, i.e. no transfer areas similar to the areas 1726 and 1728 on end modules. Connections between the row traces and the drives must be made entirely on an individual module. This requires the use of conductive vias placed between the pixel holes and interconnecting traces to connect the row traces to one or more) transfer layers. From the transfer layer the conductive path can be taken to drivers 1740 at top and bottom of the assembly. The drivers 1740 are connected with drivers on the end modules 1732 and 1736, for synchronized operation of the row traces, as well as of the column traces and color select traces.

The use of interpixel vias generally is only necessary for display designs where multiple modules are necessary. Those displays would typically be large displays (over 25 inch diagonal) where the interpixel spacing is large, allowing sufficient room for such via designs. For small displays, where the space between pixels is more limited, these vias would normally not be necessary.

Figure 18:
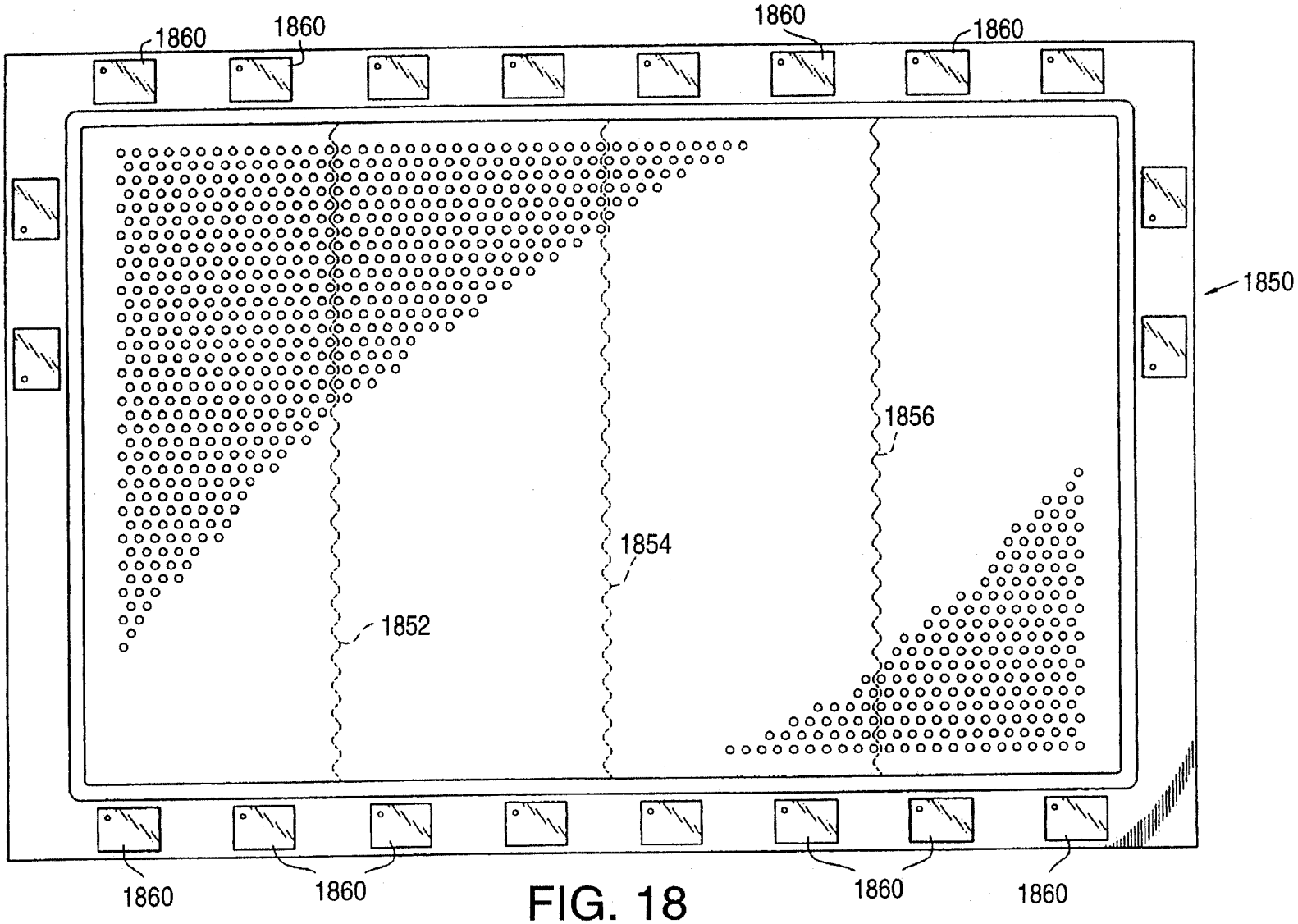
FIG. 18 is another plan view similar to FIG. 16, but showing a single module with a modular trace printing arrangement to reduce capacitance and resistance, particularly for very large screens.
Figure 19:
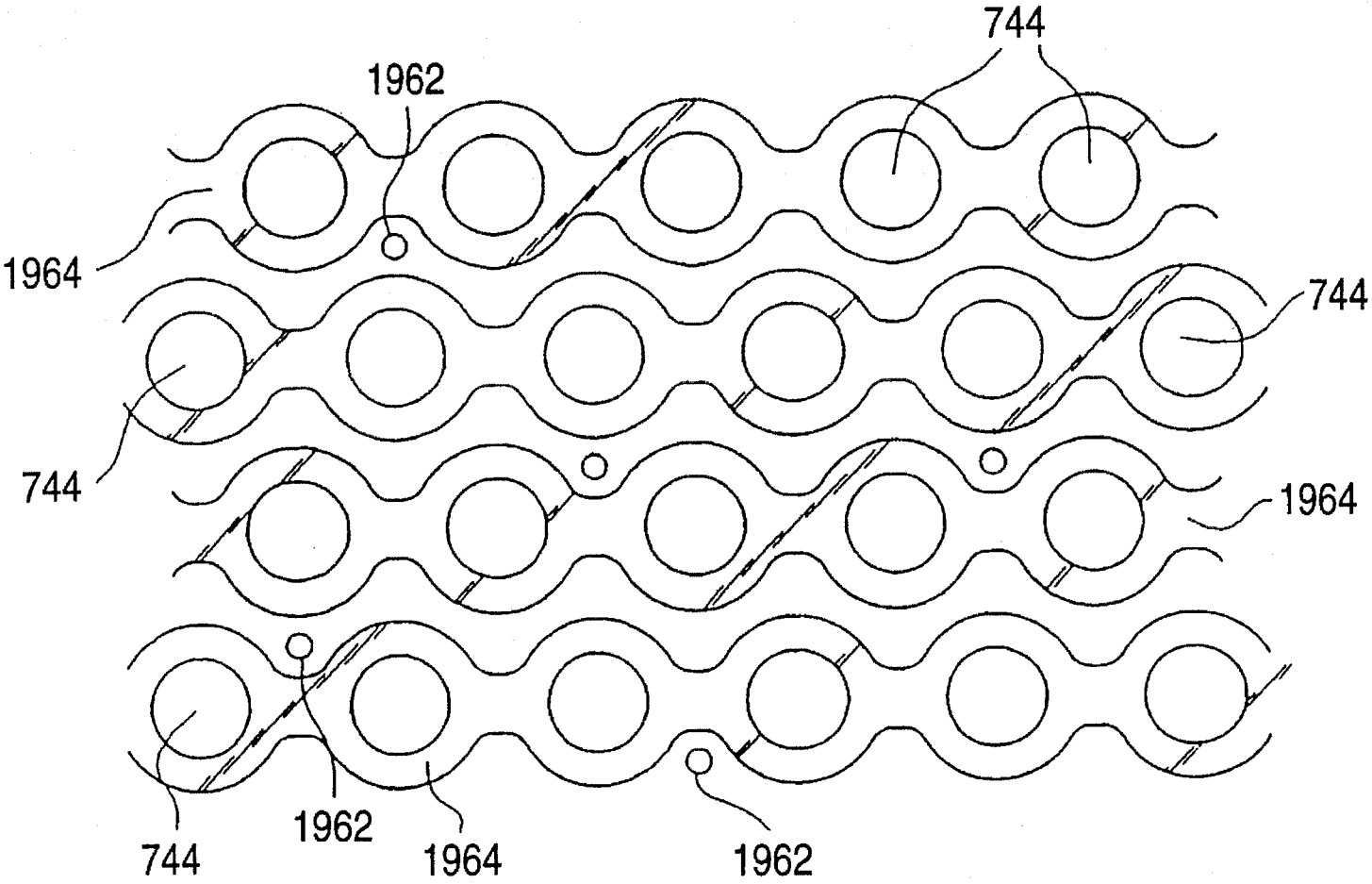
FIG. 19 is a greatly enlarged plan view showing several conductive traces around addressing holes on a layer of the grid, and showing interpixel conductive vias which are used in the embodiments of FIGS. 17 and 18.

FIG. 18 is a plan view of a display assembly 1850 which comprises a single module, rather than joined module sections. FIG. 18 illustrates the principle that the electronics can nonetheless be modular within the display, in the case of a very large display 1850. Vertical dividing lines 1852, 1854 and 1856 are shown in dashed lines in FIG. 18, to indicate that the horizontal traces are divided into four sections as far as driving electronics are concerned. In very long conductive traces, problems of capacitance and resistance will be encountered, adversely affecting the electron transfer and the operation of the display. A multiple printing scheme is used to divide each horizontal trace into multiple sections, such as four for the embodiment shown in FIG. 18. Each section along a trace line is driven separately, but in coordination, via connected drive electronics 1860. Again, interpixel conductive vias are used to bring the trace sections down to one or more transfer layers, since no margin is available at the divisions 1852, 1854 and 1856 for bringing the traces out to the edges.

Figure 20:
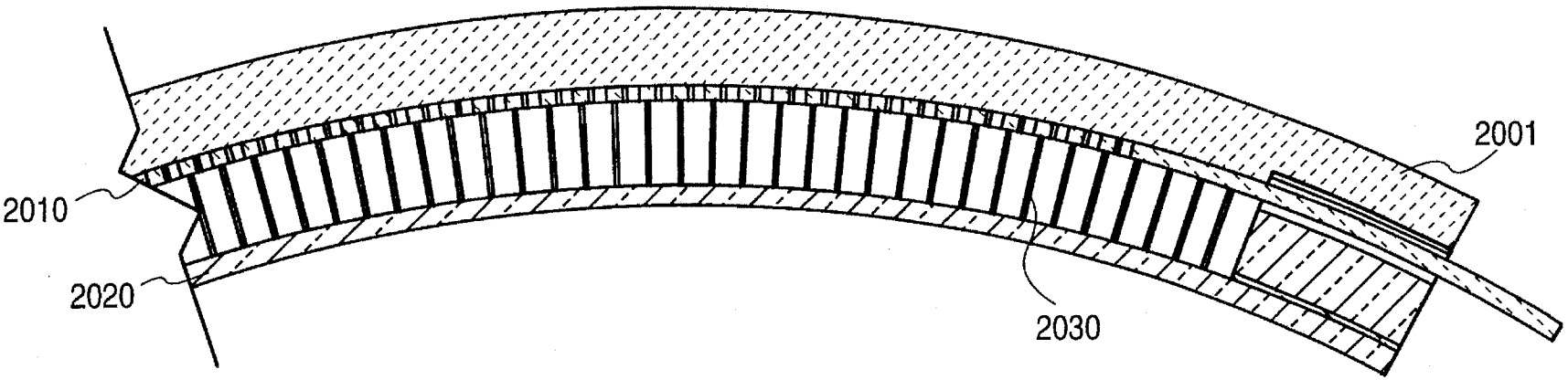
FIG. 20 shows a flat panel CRT employing a curved faceplate, baseplate, and field emitter cathode.

FIG. 20 is a greatly enlarged schematic view showing interpixel conductive vias 1962. Conductive traces, in the form described above relative to FIGS. 14A and 14B, for example, are shown at 1964. As indicated, the interpixel conductive vias 1962, which may be considerably smaller than the addressing holes 744, are placed at locations where the printed conductive traces 1964 can be separated a reasonable distance without losing any substantial portion of the conductive path.

Although this disclosure discusses flat panel cathode ray tubes and displays, the term flat panel is not used in the sense of a planar display, but rather in the sense that the tubes and displays discussed here do not have the characteristic bulge required by conventional cathode ray tubes. FIG. 20 show a flat panel CRT, in accordance with the present invention, that is curved.

In FIG. 20, baseplate 2001 has a field emitter cathode mounted or formed on its concave side. Glass faceplate 2020 has an anode formed on its convex side. Between the faceplate 2020 and the base plate 2001 is a grid 2010 that is curved to match the curvature of the base plate. Spacers 2030 support the external atmospheric pressure on the baseplate.

A flat panel cathode ray tube that uses a field emitter cathode can be convex or concave, can be curved in one direction like the side of a cylinder, or curved in two dimensions like a dish. Because field emitter cathodes are made up of a large number of micro-emitters distributed over an area, rather than wires that are supported at both ends, field emitter cathode ray tubes can easily be made in a large variety of shapes. Formation of the curved grid may be accomplished using methods described above, forming holes and patterned layers on flat sheets of unfired ceramic, then curving the flat sheets into the desired shaped for the firing process.

Certain terms are used in the above description and should be interpreted broadly. The term "hole" is intended to encompass not only circular holes, but also slot-shaped holes, elliptical holes, hexagonal holes, triangular holes, or any other shape which might be appropriate for a particular application or selected arrangement of the addressing grid and the pixels. Differently shaped holes are appropriate to different types of screens and also to the number of colors selected in a color complement for a pixel. If four-color pixels are selected, square-shaped or diamond-shaped holes may be preferred.

In this regard, although red, green, and blue colors are referred to in the above description, this is not intended to limit the invention in this aspect, and four-color pixels may alternatively be used.

Also, the term "plastic" is sometimes used herein in its technical sense of meaning workable or deformable in a nonelastic way.

The term "glass-ceramic" or "ceramic" is often used herein to refer to the family of glass, ceramic, glass-ceramic, or ceramic glass materials as described earlier. This is particularly true in reference to ceramic tapes In the description of depositing conductive traces, screening printing is often mentioned. The reference to screen printing is intended broadly, and should be understood to include lithography, flat plate printing techniques, solid conductor etching, and other printing techniques.

Lithography can actually achieve a greater density of conductive traces since, in general, ¼ micron resolution can be achieved, far higher resolution than screen printing.

The term "display" used throughout this disclosure includes also devices which are used in applications which do not involve direct viewing. For example, a flat panel display might be used to image digital information in xerographic printers and copiers.

Although the present invention has been described in detail, the description is only an example of the invention's application and should not be taken as a limitation. Many other embodiments are possible within the spirit of the present invention. For example, the number of layers in a grid can be varied, the functions of the layers can be varied, and the ordering of the layers can be varied. The geometry and materials used can be changed in a number of ways. The scope of the present invention is limited only by the claims.

We claim:

1. A flat cathode ray tube comprising:

a field emitter cathode;

an anode; and a grid interposed between the field emitter cathode and the anode, the grid having a plurality of addressing holes through which electrons emitted by the cathode flow to the anode, wherein the grid controls electron flow between the field emitter cathode and the anode, wherein:

the field emitter cathode comprises a plurality of emitters, the plurality of emitters being partitioned into a plurality of sets of emitters, each set of emitters being positioned on the field emitter cathode so that electrons emitted by the set of emitters flow through an associated addressing hole aligned with the set of emitters; and the grid further comprises a plurality of electrodes, each electrode having one or more associated addressing holes, the electrodes being positioned so that when any given electrode is at a predetermined voltage level, a flow of electrons through an addressing hole associated with the given electrode is stopped.

2. The flat cathode ray tube of claim 1, wherein the grid comprises a plurality of co-fired layers, at least one of which is ceramic material.

3. The flat cathode ray tube of claim 1, wherein the field emitter cathode, the anode, and the grid are curved.

4. The flat cathode ray tube of claim 1, wherein the grid further comprises a focusing layer that shapes the electric field inside an addressing hole so that electrons flowing through the addressing hole are focused and strike the anode within a desired area on the anode.

5. The flat cathode ray tube of claim 4, wherein the focusing layer comprises a conducting ceramic layer.

6. The flat cathode ray tube of claim 1, wherein the grid further comprises a plurality of focusing layers that shape the electric field inside an addressing hole so that electrons flowing through the addressing hole are focused and strike the anode within a desired area on the anode.

7. The flat cathode ray tube of claim 1, wherein the plurality of electrodes comprises a plurality of row electrodes formed as a patterned conducting layer, and the addressing holes which correspond to each row electrode are positioned along a line.

8. The flat cathode ray tube of claim 1, wherein the plurality of electrodes comprises a plurality of column electrodes formed as a patterned conducting layer, and the addressing holes which correspond to each column electrode are positioned along a line.

9. The flat cathode ray tube of claim 8, wherein the plurality of electrodes further comprises a plurality of row electrodes formed in a second patterned conducting layer, and the addressing holes which correspond to each row electrode are positioned along a line orthogonal to the line of addressing holes corresponding to the column electrodes.

10. The flat cathode ray tube of claim 8, wherein the grid further comprises a focusing layer that shapes the electric field inside an addressing hole so that electrons flowing through the addressing hole are focused into a beam.

11. The flat cathode ray tube of claim 1, wherein the field emitter cathode, the anode, and the grid are curved.

12. A flat cathode ray tube comprising:

a field emitter cathode;

an anode; and a grid interposed between the field emitter cathode and the anode, the grid having a plurality of addressing holes through which electrons emitted by the cathode flow to the anode, the grid controlling electron flow by switching on or off the flow through the addressing holes, wherein:

the grid further comprises a collecting layer made of conducting material and positioned close to the field emitter cathode;

the addressing holes pass through the collecting layer; and the addressing holes in the collecting layer provide an aperture through which electrons emitted by the field emitter cathode must pass before reaching the anode, the collecting layer being sufficiently thick and positioned relative to the field emitter cathode such that most of the electrons which are absorbed by the walls of the addressing holes are absorbed by the collecting layer.

13. A flat cathode ray tube comprising:

a field emitter cathode comprising;

a plurality of sets of micro-emitters; and a plurality of isolated gate patterns encompassing the sets of micro-emitters so that when the gate patterns are properly biased relative to the micro-emitters electrons are emitted from the micro-emitters;

an anode; and a grid interposed between the field emitter cathode and the anode, the grid controlling electron flow between the field emitter cathode and the anode, wherein the grid comprises a conducting row electrodes and the grid is adjacent to the field emitter cathode with the row electrode in electrical contact with the gate patterns.

14. A flat cathode ray tube comprising:

a field emitter cathode comprising a plurality of separate field emitter plates, each field emitter plate having a gate;

an anode; and a grid interposed between the field emitter cathode and the anode, the grid controlling electron flow between the field emitter cathode and the anode, wherein the grid comprises a conducting layer, and the grid is adjacent to the field emitter cathode with the conducting layer in electrical contact with the gates of the separate field emitter plates such that the gates are electrically connected together.

15. A flat cathode ray tube comprising:

a field emitter cathode comprising a plurality of micro-emitters uniformly distributed over an area of the field emitter cathode;

an anode; and a grid interposed between the field emitter cathode and the anode, the grid controlling electron flow between the field emitter cathode and the anode, wherein the grid comprises an insulating layer having a plurality of addressing holes which pass through it, the grid being positioned so that the insulating layer is in contact with the field emitter cathode with some of the plurality of micro-emitters beneath the insulating layer and some of the micro-emitters beneath the addressing holes so that, during operation of the flat cathode ray tube, a charge builds up on the insulating layer and stops the micro-emitters beneath the insulating layer from emitting electrons.

* * * * *